US005324219A

United States Patent [19]

Beltrani et al.

[11] Patent Number: 5,324,219

[45] Date of Patent: Jun. 28, 1994

[54] SWIMMING FLIPPER

[75] Inventors: Gianni Beltrani; Mirko Bosio, both of Genoa, Italy

[73] Assignee: Technisub S.p.A., Genoa, Italy

[21] Appl. No.: 61,263

[22] Filed: May 17, 1993

[30] Foreign Application Priority Data

Jun. 3, 1992 [IT] Italy ..... T092A000477

[51] Int. Cl.[5] ..... A63B 31/08

[52] U.S. Cl. ..... 441/64

[58] Field of Search ..... 441/61-64

[56] References Cited

U.S. PATENT DOCUMENTS

| | | | |
|---|---|---|---|
| 2,903,719 | 9/1959 | Wozencraft . | |
| 3,178,738 | 4/1965 | La Trell | 441/64 |
| 5,151,060 | 9/1992 | Lam | 441/62 |

FOREIGN PATENT DOCUMENTS

| | | |
|---|---|---|
| 0310828 | 4/1989 | European Pat. Off. . |
| 1078913 | 3/1960 | Fed. Rep. of Germany . |
| 2524863 | 1/1963 | Italy . |
| 799797 | 1/1966 | Italy . |
| 801541 | 1/1966 | Italy . |
| 2128096 | 4/1984 | United Kingdom . |

*Primary Examiner*—Jesus D. Sotelo

*Attorney, Agent, or Firm*—Sughrue, Mion, Zinn, Macpeak & Seas

[57] ABSTRACT

Swimming flipper comprising a blade and a shoe constituted by two distinct and separable elements provided with a mutual disengageable restrained joint coupling for performing an automatic rigid step-in engagement following approach from above downwardly of the shoe relative to the blade according to a translation movement in a direction substantially perpendicular to the plane of the blade, or following a translation-rotation movement.

30 Claims, 17 Drawing Sheets

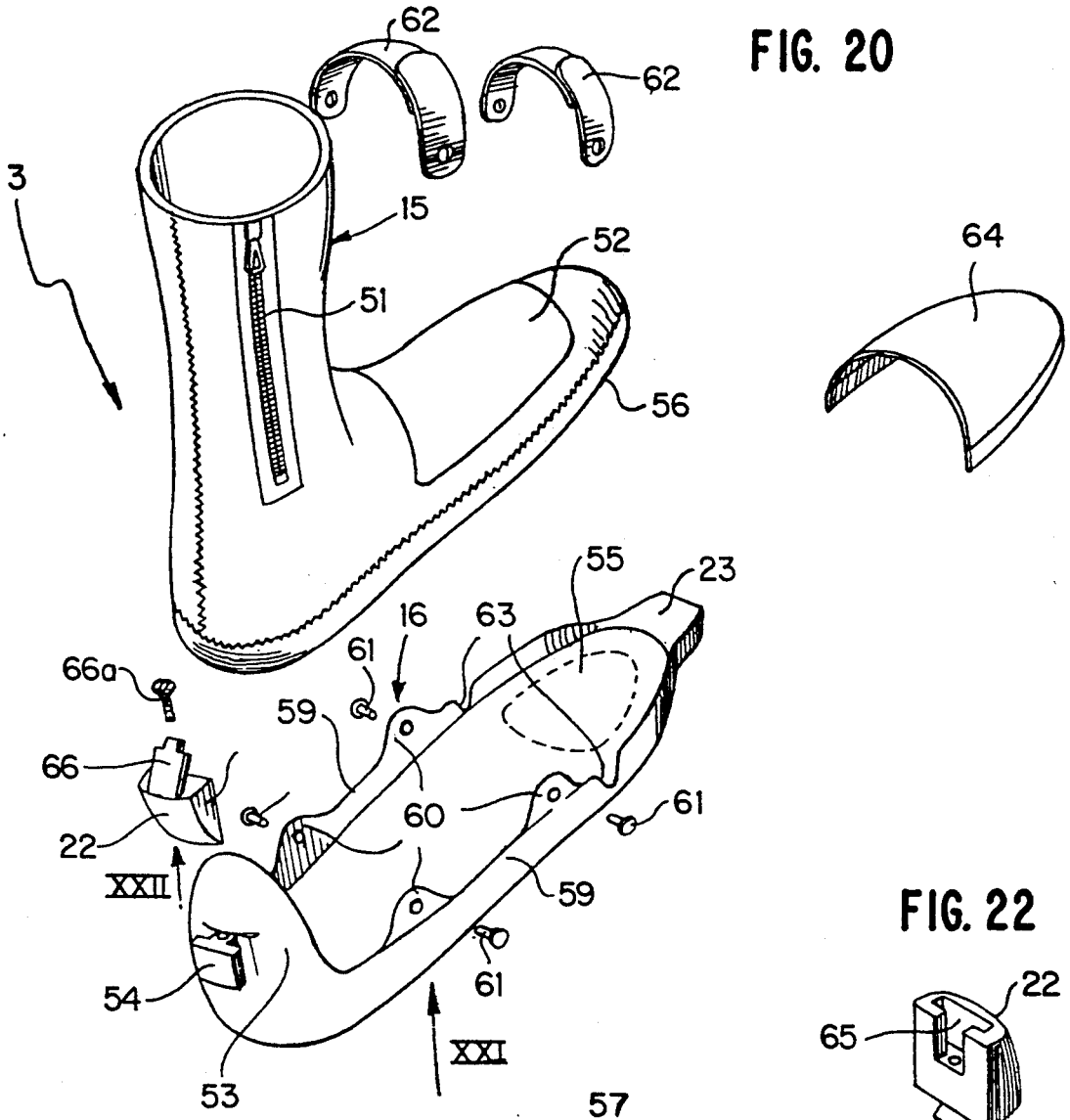
FIG. 20
FIG. 22
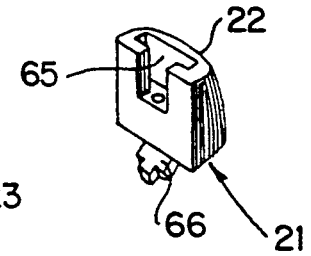
FIG. 21
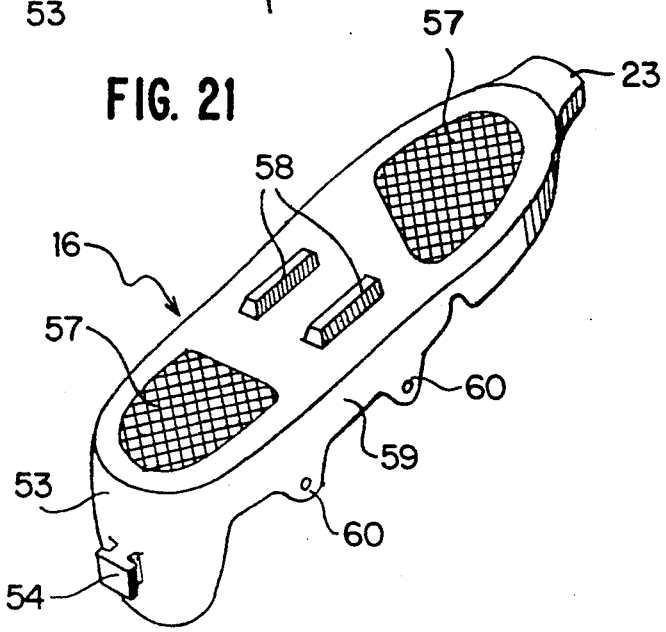

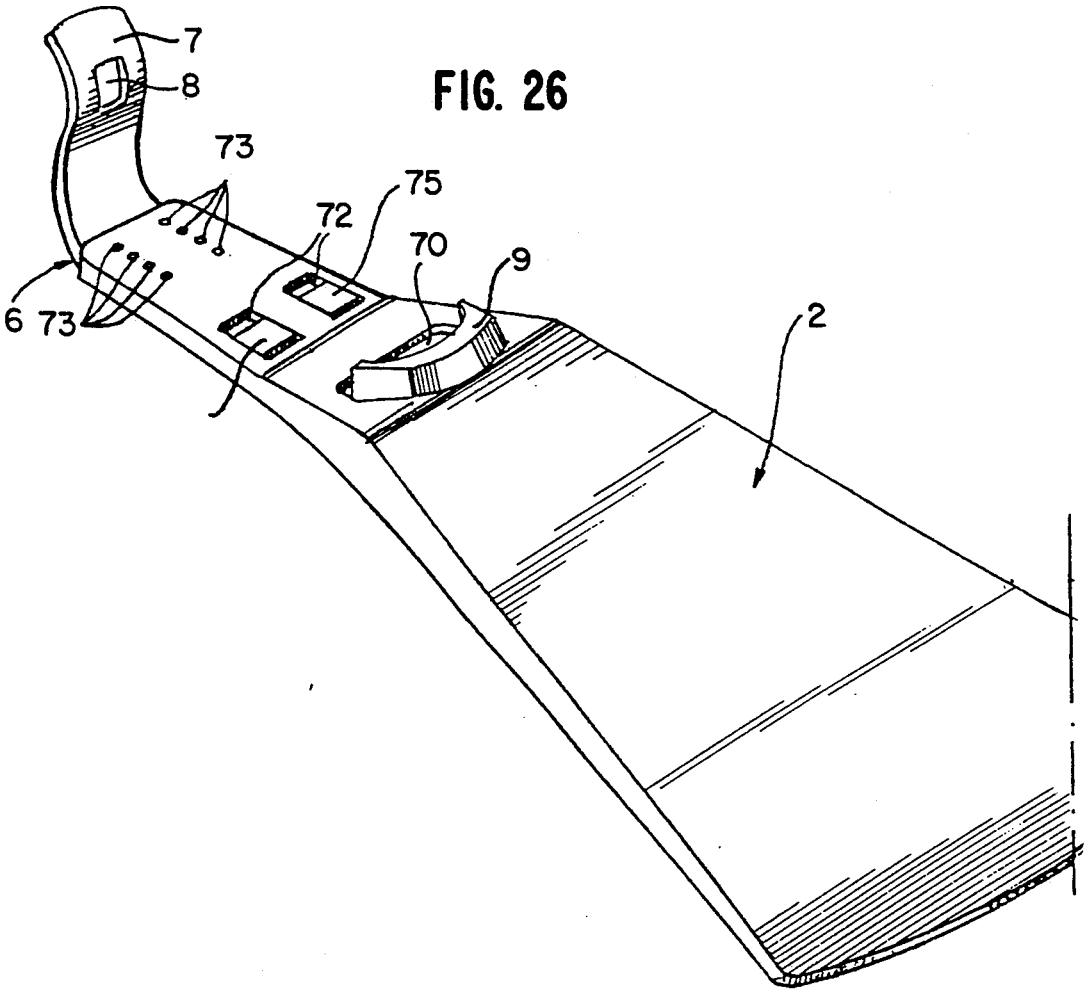
FIG. 26
FIG. 29
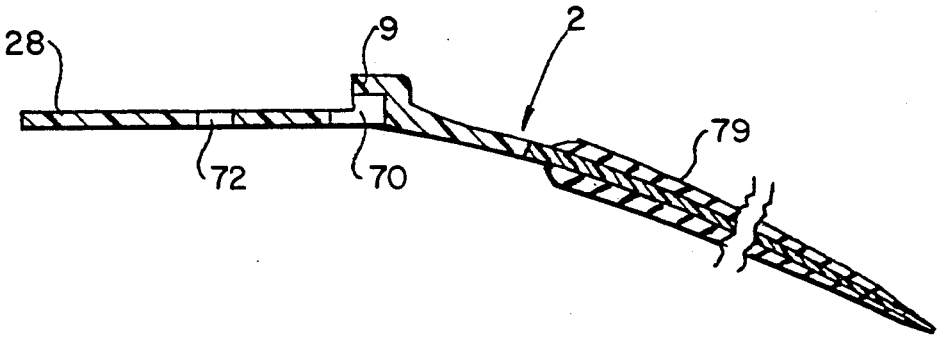

SWIMMING FLIPPER

BACKGROUND OF THE INVENTION

The present invention is related to swimming flippers comprising a blade of flexible and relatively rigid material, and a shoe of relatively soft and elastically extensible material associated to one end of the blade.

In the swimming flippers presently produced the shoe, be it either formed with a complete shape or open rearwardly and provided with a strap (for the rear holding of the foot and for the length adjustment of the housing thereof), is rigid with the blade, or in any case is permanently assembled thereto by means of mechanical systems allowing assembly and disassembly of the two parts only with the aid of suitable tools, and in any case not when the shoe is worn on the user's foot.

For the manufacturing of flippers of the above-referenced type, long since discontinued the production methods consisted of the simultaneously moulding in a single mould of curable rubbers of different hardness. The manufacture technology has by now been consolidated, comprising initially the injection moulding of the blade, employing a rigid and flexible thermoplastic material having a low melting point, normally E.V.A. (Ethylene Vinyl Acetate) or rigid polyurethane or other polymers. Thereafter, on the rear end of the blade so formed the shoe is overmoulded, for which is normally employed a thermoplastic rubber having chemical affinity with the thermoplastic material of the blade and a higher melting temperature, so that it can be welded to the blade due to a chemical-thermal effect.

A technology more frequently adopted for specialized uses of the flipper (agonistic flipper-swimming, deep sea diving) consists of a moulded shoe of generally natural rubber, sometimes a thermoplastic rubber, and a blade of rigid and flexible material coupled and fixed therebetween by means of mechanical systems, normally by screws. This type of connection, which can be disconnected only with the aid of proper tools, also leads to flippers which, both from the point of view of the user and during operation, must be considered as "monolithic", even if uncoupling of the two parts is allowed for the purpose of replacement.

These monolithic flippers have several drawbacks, summarized in the following.

a) Firstly, the monolithic flippers involve several difficulties and inconveniences in connection with wearing and removing, for which the user is obliged to intervene manually, frequently with both hands, either for inserting or for withdrawing the foot relative to the flipper. It is also to be considered that, in case of use for scuba diving, these operations are performed by the completely dressed diver, i.e. wearing a diving suit, weights, breathing apparatus, diving jacket, with precarious equilibrium conditions, on the sea shore or within the waves of the water line, on the deck of a rolling boat or below the ramp of the boat itself. On the other hand the flipper must be worn and removed when going in and out the water, since walking on flippers is almost impossible and anyway dangerous.

b) In the case of rearwardly open shoes provided with a strap for the back holding of the foot, the obstacle determined both by the shoe length, and by the tails of the strap projecting laterally, as well as by the large buckles for connecting and adjusting the strap, originates an appreciable hydrodynamic resistance which limits in use the efficiency of the flipper motion. As far as the length of the rearwardly open shoes is concerned, same is due to the fact that such shoes are not worn on the bare foot or possibly on a thin protective socking, but on an ankle-boot made of neoprene or similar materials, having a rubber anti-slip sole, which is per se particularly thick. This ankle-boot accomplishes both the ambulation function, and the thermal protection task: use thereof is normally widespread, but involves relevant problems of hydrodynamics and of connection solidity between foot and flipper.

In more remote times, when the moulding technologies and the available materials did not enable overmoulding a relatively soft material (that of the shoe) on a relatively rigid material (that of the blade), in order to obtain sufficiently differentiated characteristics of rigidity or elasticity, not obtainable with a monolithic structure of the flipper, it had been proposed to manufacture the shoe and the blade as distinct elements, assembled to each other mechanically with mutual restrained-joint systems.

Examples of these solutions are disclosed in Italian patents n. 709845, n. 799797 and n. 801541.

These solutions contemplated lateral members of mutual fitting, placed on the sides of the shoe and of the blade, adapted to be fixedly joined with each other and to be disassembled by means of approaching and, respectively, departing the two parts along a direction parallel to the plane of the blade, i.e. in a forward-rearward direction. These operations involved the application of a huge thrust force (or of a traction force, respectively), with a relevant manual effort, normally with the aid of suitable tools, and not without engagement and disengagement difficulties of the parts for the mutual restrained-joint.

Such solutions, which evidently did solve the problem of making the shoe and the blade by different materials, were only directed to the manufacturers, certainly not to the users. Actually:

a) the separation and union of the two flipper components would have required for the user still more uncomfortable, difficult and hard wearing and removing operations with respect to the monolithic flippers, and thus not practicable;

b) these flippers did not afford any advantage connection with the hydrodynamic friction: on the contrary, the restrained joint members did increase the plan width thereof;

c) such flippers didn't lead to the achievement of any advantages either with respect to the solidity of connection between foot and blade: the shoe was normally loose and slack, and moreover the blade was fitted only in the forward half of the shoe, thus allowing under effort a foot flexion which strained the leg and considerably reduced the swimming efficiency.

SUMMARY OF THE INVENTION

The object of the present invention is to overcome the above mentioned drawbacks both of the so called monolithic flippers, and of the flippers formed by two parts coupled to each other such as previously disclosed, and to provide a swimming flipper wherein the blade and the shoe are constituted by two distinct elements adapted to be separated from each other and provided with means of mutual restrained-joint coupling enabling separation and putting together the blade and the shoe in a simple and rapid way, also when the shoe is worn on the user's foot.

A further object of the invention is to allow coupling between the shoe and the blade automatically, without any need of manual intervention, by means of a single "step in" operation.

Still another object of the invention is to enable the separation between the shoe and the blade with only one hand and with a minimum effort, also through a single operation.

Still a further object of the invention is to provide an amphibious footwear, which allows both walking in the same way and even better in that it is made possible by the current isothermal ankle-boots, and swimming in the same way and even better than the prior art flippers permit, and changing from one condition to the other—walking/swimming and viceversa—by easy, rapid and instinctive actions adapted to be carried out even in a complete diver's configuration, possibly even with his isothermal boots already worn.

A further object of the invention is to let the shoe allow—besides the possible isothermal protection due to the use of an insulating material such as foamed cellular neoprene—a comfortable and easy walking, by virtue of a semi-rigid anti-slip sole, well secured to the shoe, possibly by means of straps adapted to be tightened in an adjustable way with hook-and-loop fasteners or the like.

A further object of the invention is to enable the blade to be connected or disconnected relative to the shoe either when the shoe is not worn on the user's foot, or, particularly, when the user is already wearing the shoe.

Still another object of the invention is to avoid chemically-obliged selections for the material of the blade and that of the shoe, as it is instead required in the case of flippers formed by different materials adapted to be welded to each other by co-moulding.

A further object of the invention is to provide, in the coupled condition between the blade and the shoe, a joint between the foot and the blade which is rigid and without yielding or play, for the best transmission of the swimming effort from the foot to the blade.

A further object of the invention is to provide a connection between the shoe and the blade which is constructively simple, compact and substantially devoid of parts which may induce hydrodynamic resistance effects.

A further object of the invention is to provide a connection between the shoe and the blade which is adapted to ensure a high degree of safety against risks of undesired disengagement in use.

According to the invention, these objects are achieved by virtue of the fact that, in a swimming flipper of the type set forth hereinafter the means for the mutual restrained joint between the shoe and the blade perform a quick automatic snap-fit engagement following approach of the shoe and the blade relative to each other in a direction substantially perpendicular to the plane of the blade.

In the following description and claims, the term "direction substantially perpendicular to the plane of the blade" is intended to designate both a translation movement, for instance from above downwards of the shoe towards the blade placed on a support surface, and a composite translation-rotation movement, with an initial phase of translation of the tip or of the heel of the shoe until resting on the blade, followed by a final rotation phase of the shoe so as to bring also the heel or, respectively, the tip to lay onto the blade.

It must also be clarified that under the term "shoe" it is to be intended an assembly formed by a rubber-like portion (foamed neoprene, elastic thermal insulating material), having a low configuration (i.e. shaped as a normal shoe) or having a tall configuration (i.e. shaped as an ankle-boot), and by an anti-slip sole, the said assembly being conveniently equipped with slide-fasteners, straps or hook-and-loop fasteners or the like, ensuring both easy wearing and the possibility of tightening and improving foot restraint.

The said means for the mutual restrained joint between the shoe and the blade comprise conveniently a substantially rigid sole, and preferably having a unidirectional flexibility (such as to allow flexion and bending of the tip portion of the shoe upwardly, for enabling a normal ambulation, but not downwardly to avoid negative effects on operation during swimming) associated to the shoe and having a tip portion and a heel portion, and a toe holder and a heel locking member associated to the blade and cooperating with the tip portion and with the heel portion of the said sole, respectively.

According to a preferred embodiment, the heel portion of the shoe is provided with a hooking-tooth back appendage and the heel locking member carried by the blade comprises an elastically deformable wing projecting in a direction substantially perpendicular to the blade and having a recess therein adapted to be snap-engaged by the said hooking tooth.

The hooking tooth and the elastically deformable wing are conveniently formed with respective skid surfaces adapted to slidingly cooperate with each other during approaching of the shoe and the blade relative to each other so as to allow snap-fitting of the said hooking tooth within the recess of the wing.

The toe holder and/or the heel locking member can be advantageously fixed to the blade in an adjustable way, so as to allow the use of the flipper with shoes of different sizes, or use of different blades on the same shoe.

Safety means are conveniently further provided for preventing accidental disengament between the shoe and the blade during use of the flipper.

The holding toe and/or the heel locking member can be formed by distinct members mechanically fixed to the blade, or carried by a plate in turn fixed to the blade, or can be integral or co-moulded with the blade.

As far as the sole is concerned, the invention contemplates two alternative embodiments: the first consists of providing a special boot, having the sole incorporated therewith, and the second consists of employing a normal boot available on the market with the addition of an overshoe incorporating the sole. In other words, the sole of the shoe can be directly integrated therewith by glueing, overmoulding, sewing or other equivalent systems, or can be constituted by a planar ("sandal" or "overshoe") having preferably a unidirectional flexibility, distinct from the shoe and connected thereto in a releasable way. It is clear that the first solution allows best integration, extremely reduced dimensions and perfect hydrodynamics: however, it involves the production of "dedicated" shoes. On the other hand the second solution, functionally less brilliant, enables the use of normal existing diving boots, on which the overshoe can be worn.

BRIEF DESCRIPTION OF THE DRAWINGS

Further features on the invention will become apparent from the following detailed description, with reference to the attached drawings provided purely by way of non limiting example, wherein:

FIG. 20 is an exploded perspective view of a further and preferred embodiment of the flipper shoe, FIG. 21 is a perspective view according to arrow XXI of FIG. 20, FIG. 22 is a perspective and enlarged view according to arrow XXII of FIG. 20, FIGS. 23 through 25 show perspectively and diagrammatically the "step-in" sequence of the flipper, generally corresponding to the embodiment of FIG. 1, FIG. 26 is a perspective view showing a further embodiment of the invention, FIG. 29 is a view similar to FIG. 27 showing a further embodiment of the invention.

DETAILED DESCRIPTION OF THE INVENTION

Figure 1:
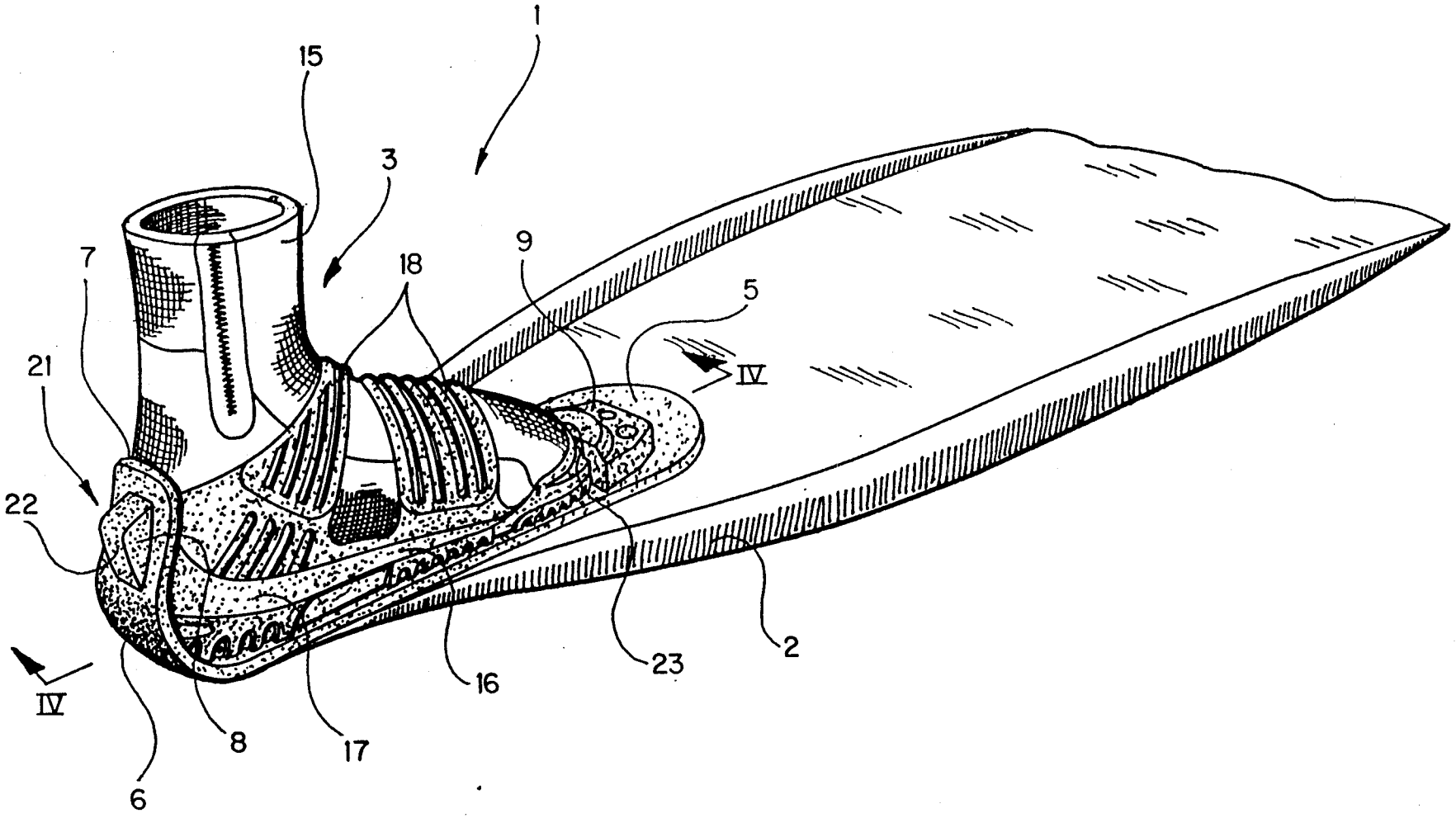
FIG. 1 is a diagrammatic perspective view of a swimming flipper according to the invention.
Figure 2:
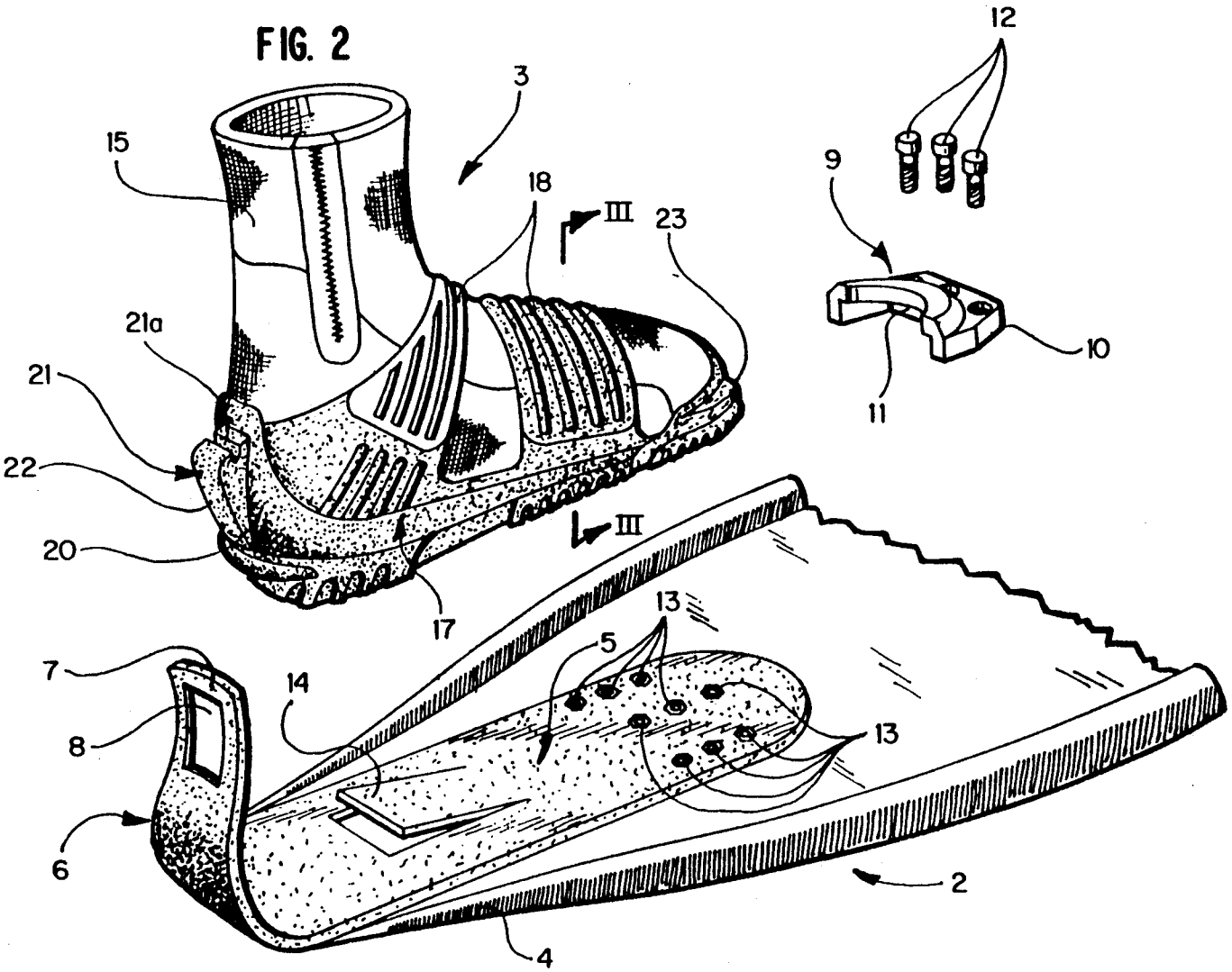
FIG. 2 is an exploded perspective view of FIG. 1.
Figures 3, 4:
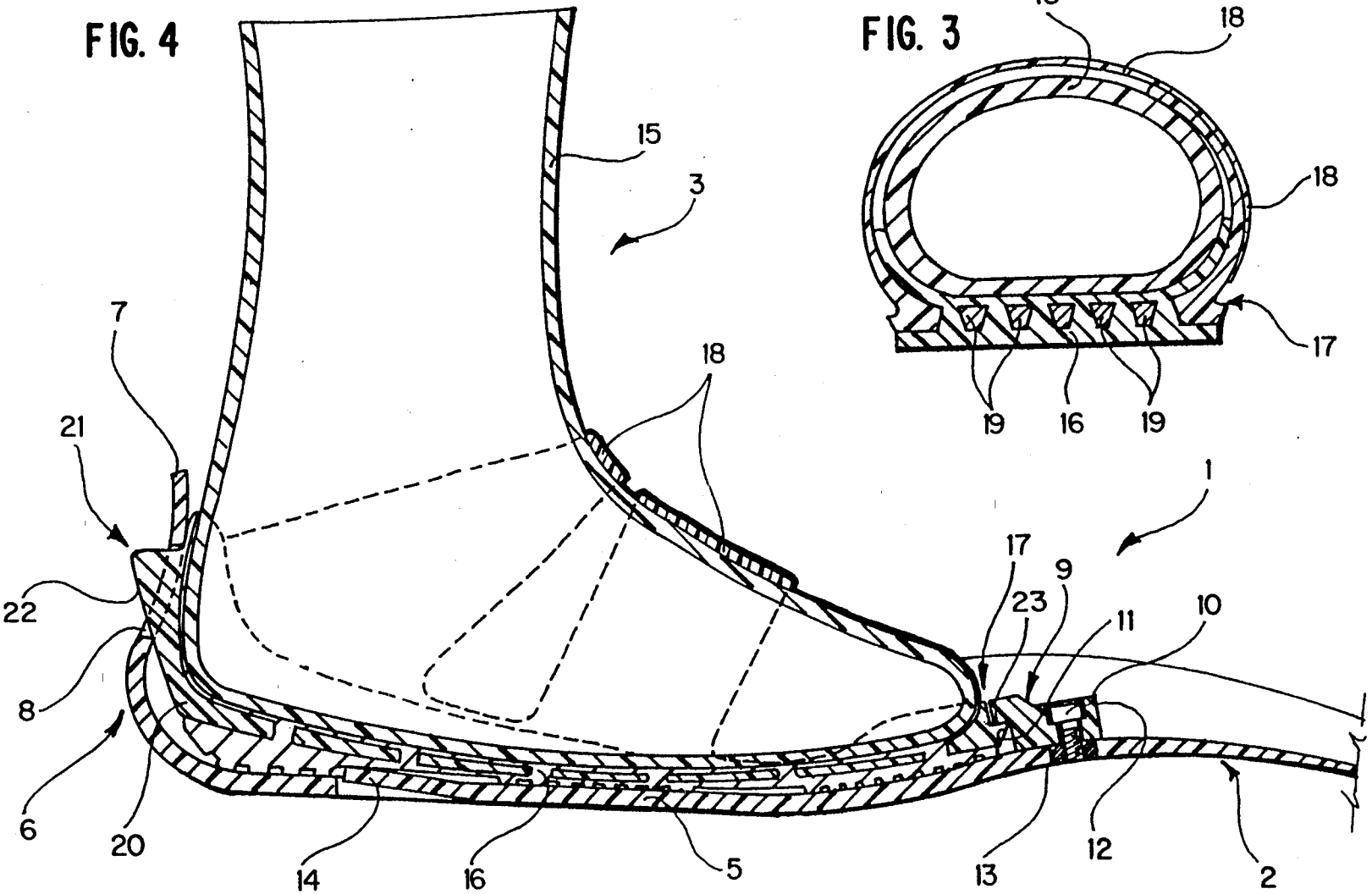
FIG. 3 is a cross sectioned view along line III—III of FIG. 2.
FIG. 4 is a longitudinal section along line IV—IV of FIG. 1.

Referring initially to the example shown with reference to FIGS. 1 through 4, a swimming flipper 1 according to the invention essentially comprises a blade 2 and a shoe 3 constituted by two distinct elements which can be separated from each other and coupled to each other in a rigid way.

The blade 2 is constituted by a plate of relatively rigid and flexible plastic material, possibly having a multilayer structure according to the teachings of European patent application EP-A-0436927 in the name of the same Applicant.

The blade 2 has a rear tapered end 4 in correspondence of which a plate 5 is applied, normally made of metal or plastic material, which can be defined as a "binding" on the analogy of systems employed in other technical fields (for instance in the field of skiing) for fastening a shoe to a member adapted to be used fixedly with the shoe itself.

The plate 5 can be welded, glued or fixed by any equivalent system to the blade 2, or it can be integrated by moulding or even formed in one piece with the blade itself, by means of a localised thickening of the central area of the tapered end 4.

The rear end of the plate 5 is formed with a wing 6 bent substantially perpendicularly to the plane of the blade 2 and having a terminal portion 7 slightly arcuated in a direction opposed to the said blade. Below the terminal portion 7, the wing 6 is formed with an opening 8 the function of which will be clarified in the following.

The wing 6 is elastically deformable, i.e. is able to spring relative to the plate 5, and defines a heel locking member cooperating, in the way which will be clarified in the following, with the shoe 3.

A toe holder 9 is placed in proximity to the end of the plate 5 opposed to the heel locking member 6, having a mounting portion 10 fixed to the plate 5 or directly to the blade 2, and defining a holding receptacle 11 also intended to cooperate, as explained hereinafter, with the shoe 3.

The receptacle 11 can be shaped as a closed recess, such as shown in the example of FIGS. 1 through 4, or it can be formed with different shapes, which will be disclosed in the following.

In the case of the shown example, fixing between the mounting portion 10 of the toe holder 9 and the plate 5 is made in an adjustable way, so as to allow variation of the distance thereof relative to the heel locking member 6, by means of screws 12 adapted to be engaged within a plurality of threaded holes 13 of the plate 5.

Alternatively, the toe holder 9 can even be permanently fixed to the plate 5, and even be formed in one piece therewith, such as explained in the following.

In the central area of the plate 5 a thrust elastic member is disposed which, in the case of the shown example, is constituted by a spring tab 14 projecting, relative to the plane of the blade 2, on the same side of the heel locking member 6. This thrust elastic member is not a strictly necessary element, and in any case it could be replaced by equivalent elements adapted to perform the same function, such as for example a metal or plastic material spring having a different shape, or an elastic shim made of rubber, suitably positioned.

The shoe 3 comprises, in the case of the shown example, an ankle-boot 15 of soft material, for instance of elastomeric material or the like (according to the most common technology, foamed cellular neoprene lined by an anti-tearing fabric), having a sole 16 which is substantially rigid or anyway preferably provided with a unidirectional flexibility for facilitating walking.

More particularly, the sole 16 should preferably be provided with the following features:

it must have a certain degree of twist rigidity, in order to avoid lateral skidding or "sideslip" effects of the flipper in the water;

it must be able to deflect by bending upwardly the tip portion, for ambulation;

it must not deflect by bending downwardly the tip portion, since in the opposite case power during flipper motion would be wasted, and moreover the shoe might disengage from the blade 2 in use.

In order to achieve unidirectional flexibility several expedients can be considered, such as for example the formation of undercuts in predetermined areas of the base of the sole 16, or the use of a simple vertical perimetral shoulder (such as in conventional shoes), collapsible under compression but unextensible under traction, or any other suitable expedient adapted to this purpose. For instance, the above mentioned shoulder could be formed with lateral cuts, such as it will be better explained in the following.

The sole 16 can preferably be made as an integral part of the shoe 3, such as disclosed hereinafter, or alternatively, as in the case of the shown example, it can be formed by a distinct planar member which is part of an overshoe 17 detachably connected to the ankle-boot 15, for instance by means of top straps 18 with hook-and-loop fasteners, buckles or equivalent system. These fasteners must be able to facilitate wearing and adjustment, according to the user's demands, tightening of the overshoe 17 on the foot, enabling both a comfortable ambulation and a powerful force transmission during swimming. It must be pointed out that the top tightening straps can even be used when the sole 16 is directly integrated with the shoe 3, since they can perform the tasks of adjustment and of rendering fixed the dynamic coupling foot/blade. With a tightened adjustment of the straps, the foot can transmit the power to the blade with immediateness, precision and high efficiency, without useless hysteresis.

It is not to be excluded that the overshoe 17 is directly worn on the bare foot, or on the foot simply protected by an isothermal sock.

Reverting to the shown example, the overshoe 17 can be made of relatively rigid plastic material, and the sole 16 has a thickened cross section with longitudinal inner reinforcement and stiffening elements 19. Possibly, the sole can also be partially or totally covered by anti-slipping rubber.

The heel portion of the overshoe 17, indicated as 20, is formed with a hooking tooth 21 projecting outwardly and placed at a level corresponding to that of the opening 8 of the heel locking member 6. As it is better illustrated in FIG. 4, the hooking tooth 21 has a lower skid surface 22 whose shape is complementary to that of the bent terminal portion 7 of the heel locking member 6.

In correspondence of the forward end of the shoe 3, the sole 16 is formed with a tip projection 23 whose shape is complementary to that of the receptacle 11 of the holding toe 9.

In practice the two terminal points of the sole (hooking tooth 21—tip projection 23), connected substantially rigidly to each other through the sole 16, define a control arm for the power transmission during flipper motion. It must be pointed out that the length of this control arm is generally much longer than in the case of flippers according to the prior art, which affords in use a more relevant transmission of the swimming power.

In operation, the user preliminarily wears the shoe 3 and then the overshoe 17, and is thus able to walk freely and without any difficulty until the time of real need of employing the flipper, possibly maintaining a loose adjustment of the tightening straps 18 for a better comfort. At the time of use, the blade 2 is simply laid onto a support surface (shore, edge of a swimming pool, deck of a boat) even standing up without the need of bending down or using hands, with the heel locking member 6 facing upwardly. Then, after having if necessary tightened the fastening straps 18, the user approaches the shoe 3 to the plate 5, firstly introducing the tip projection 23 within the receptacle 11 of the toe holder 9. Subsequently, by simply lowering the heel towards the plate 5, snap-fitting between the hooking tooth 21 and the opening 8 of the heel locking member 6 is performed, thus rigidly locking the shoe 3 relative to the blade 2.

The snap fitting between the tooth 21 and the opening 8 is obtained by virtue of the elastic bending rearwardly of the heel locking member 6, carried out owing to the sliding contact between the skid surface 22 of the tooth 21 and the terminal bent portion 7 of the heel locking member 6.

It should be pointed out that snap fitting could also be performed, instead than due to bending of the heel locking member 6, by virtue of rearward rotation of at least one rigid articulated part thereof, against the action of a reaction spring. This solution, not shown in the drawings, is however more complicated, and the elastically bending construction disclosed in the above for the heel locking member 6 is considered even more reliable.

In the locked condition, the elastic tab 14 of the plate 5 is elastically deformed downwardly, thus applying onto the sole 16 a thrust directed upwardly, which ensures a firm and free of play restraint of the hooking tooth 21 against the upper edge of the opening 8. In practice the tab 14 constitutes a security member against risks of accidental or anyway undesired disengagement of the shoe 3 relative to the blade 2. It is clear that the function of the elastic tab 14, which in any case is not strictly necessary, can also be performed by a metal or plastic material spring, or by an elastically compressible rubber shim, or by similar systems.

In order to further improve the safety against accidental disengagement, seats or notches **21*a* can be formed on the upper side of the tooth 21, and even flexible hooking appendages can be provided (such as it will be clarified in the following), adapted to engage and retain the upper edge of the opening 8**.

In order to disengage the shoe 3 it is sufficient to push rearwardly the heel locking member 6 so as to withdraw the hooking tooth 21 from the opening 8. This operation can be simply carried out with one finger, or by means of a rod, or by means of the sole of the other flipper as well.

It will be apparent from the above that the flipper according to the invention enables coupling and uncoupling between the shoe 3 and the blade 2 in an extremely comfortable, practical and simple way. Coupling can be performed automatically, without the need of any manual intervention, while uncoupling requires in any case a minimum effort, intervening with only one user's hand or of a suitable tool, or by means of the sole of the other foot.

In the coupled condition, the connection between the shoe 3 and the blade 2 is absolutely rigid, which ensures the best transmission of the swimming force to the blade 2, and thus the maximum thrust efficiency by the latter. Moreover the fastening straps 18 ensure a solid connection between the user's foot and the shoe 3.

The overall dimensions of the parts for mutual coupling between the shoe 3 and the blade 2 are extremely reduced, and in any case there is no lateral projection which might generate hydrodynamic resistance effects, or which might cause accidental separation between the shoe and the blade.

Naturally the details of construction and the embodiments of the flipper can be widely varied with respect to what has been disclosed and illustrated, without thereby departing from the scope of the present invention. Thus, for example, the toe holder 9 and the heel locking member 6 could have different shapes with respect to those disclosed with reference to the above example, provided that same can afford a rapid automatic snap-fit engagement of the shoe 3 relative to the blade 2 following a mutual approaching therebetween along a direction substantially perpendicular to the plane of the blade 2, such as clarified at the beginning, i.e. following a translation movement from above downwardly, or following a composite movement of translation-rotation.

Figure 5:
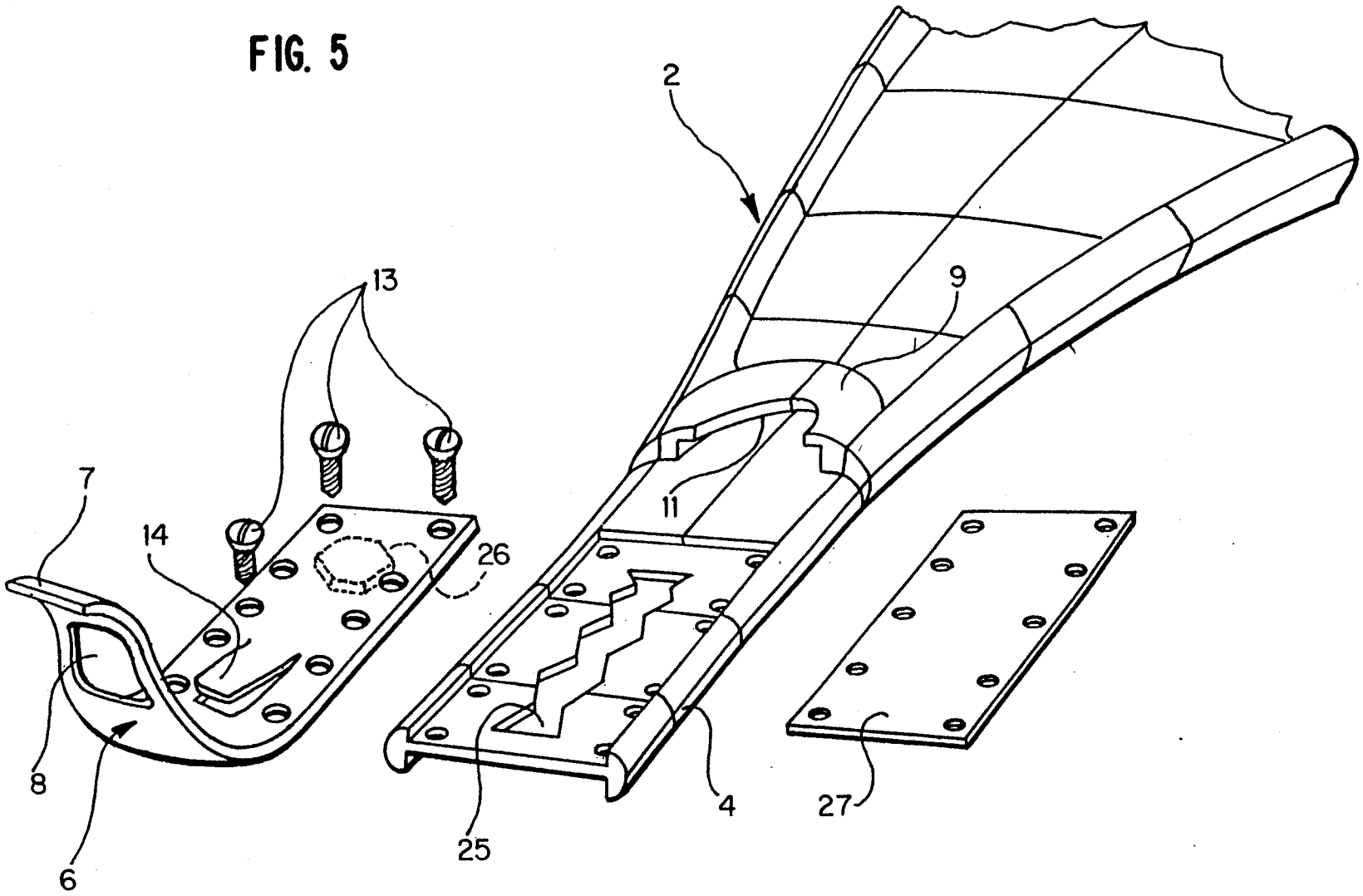
FIG. 5 is an exploded perspective view of an alternative embodiment of the flipper blade.

FIG. 5 shows an alternative embodiment in which the plate 5 is suppressed (i.e. is integral with the blade 2), the toe holder 9 is co-moulded with the blade 2, and the heel locking member 6 is adapted to be fixed on the rear portion 4 of the blade 2 in an adjustable way. To such effect the portion 4 is provided with a profiled central groove 25 directed longitudinally and adapted to be engaged by a projection 26 fixed to the lower face of the plate 5. After determining the desired adjustment position, the plate 5 is fixed by means of the screws 13 which cross the rear portion 4 and engage a lower counterplate 27.

Figure 6:
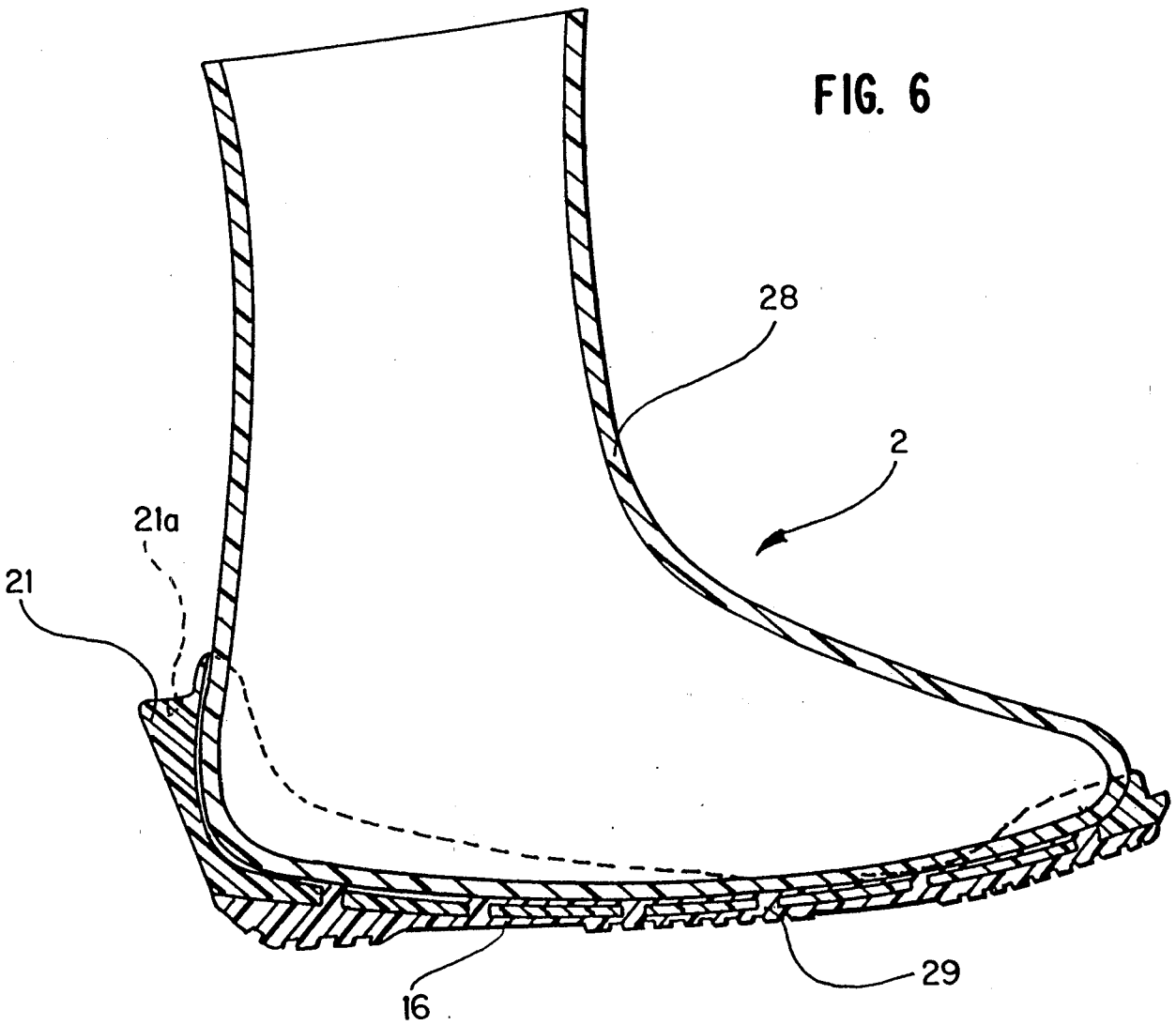
FIG. 6 is a longitudinally sectioned view of an alternative embodiment of the shoe, FIGS. 7 through 17 diagrammatically show further alternative constructive embodiments of the invention.

FIG. 6 shows an alternative embodiment according to which the sole 16 is directly integrated with the shoe 3. In this case, the shoe is formed by a boot 28 for instance made by foamed neoprene, glued onto the sole 16 of substantially rigid material and having a unidirectional flexibility, and a layer of rubber 29 is overmoulded on the sole 16 so as to ensure both anti-slippling characteristics and glueing with the boot 28.

Figure 7:
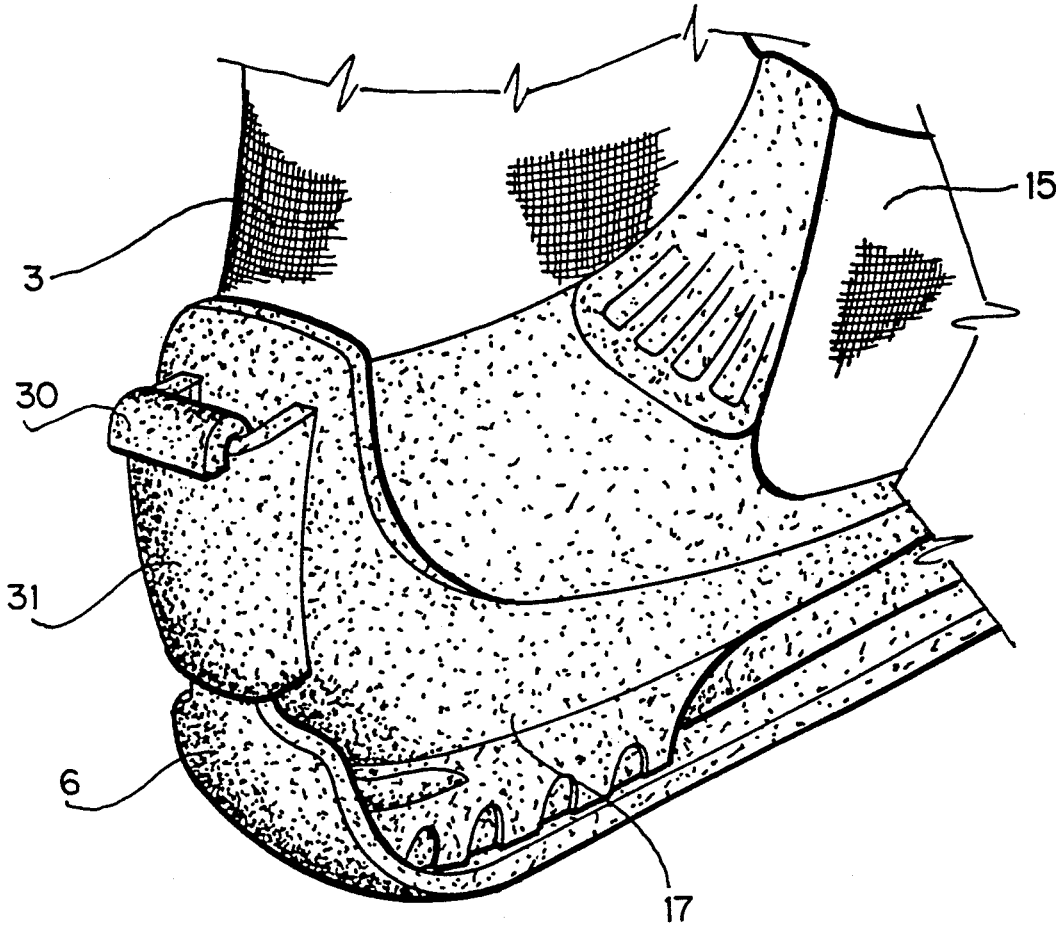
Figure 8:
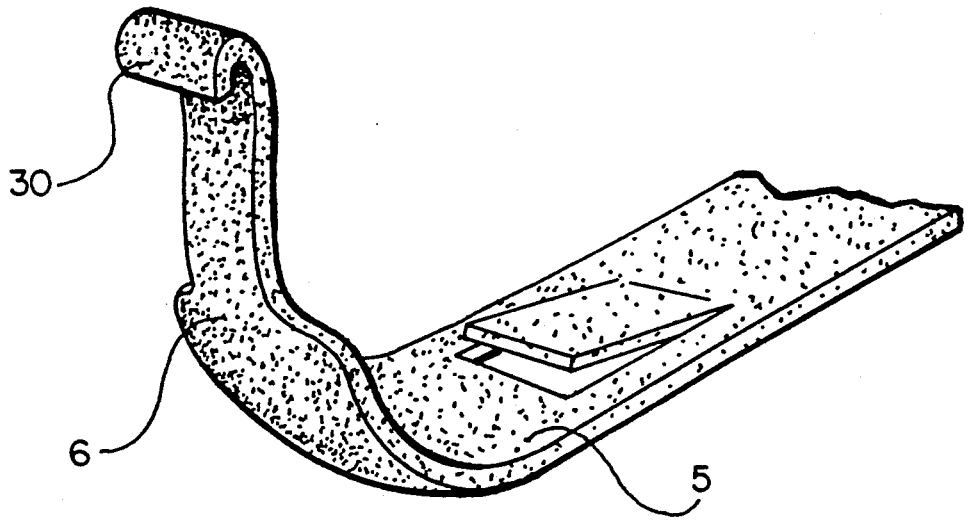
Figure 9:
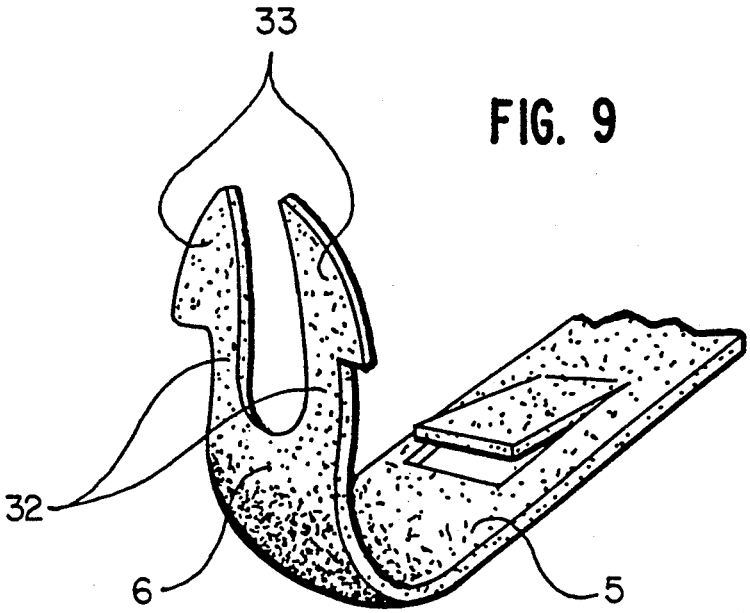

The safety system for preventing accidental or anyway undesired disengagement of the shoe 3 relative to the blade 2 can also be made according to the alternative embodiments depicted in FIGS. 7, 8 and 9. In the case of FIGS. 7 and 8, the heel locking member 6 is formed with an upper hook-bent end 30 and the hooking tooth 21 of the shoe 3 is replaced by a hollow projection 31 adapted to be crossed by the heel locking member 6 and engaged from above by the hook-bent end 30.

According to FIG. 9, the heel locking member 6 is formed with two vertical branches 32 which can be elastically drawn near to each other and having at their ends respective hooking teeth 33 intended to pass through the hollow projection 31 and to engage thereabove.

Figure 12:
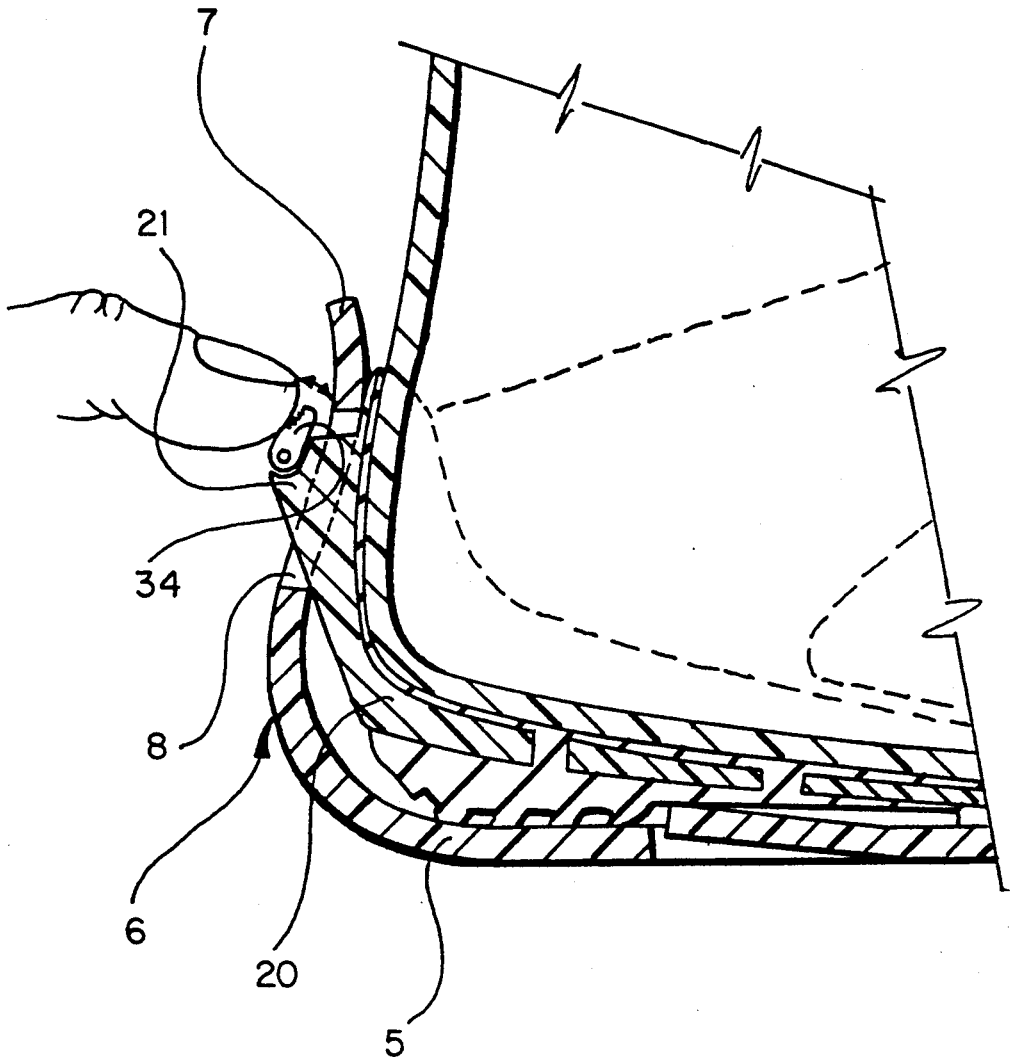

A further safety system is shown in FIG. 12: it comprises a spring pawl 34 supported in correspondence of the upper end of the hooking tooth 21 and adapted to be automatically rotated downwardly, against the action of the spring, when the hooking tooth 21 is introduced through the opening 8 of the heel locking member 6. In order to disengage the tooth 21 from the opening 8 it is then necessary to manually push downwardly the pawl 34 so as to disengage same from the upper edge of the opening 8. The same effect can be obtained even without articulated elements, simply forming on the hooking tooth 21 appendages or projections made of a high-resistance and elastically deformable material.

Figure 10:
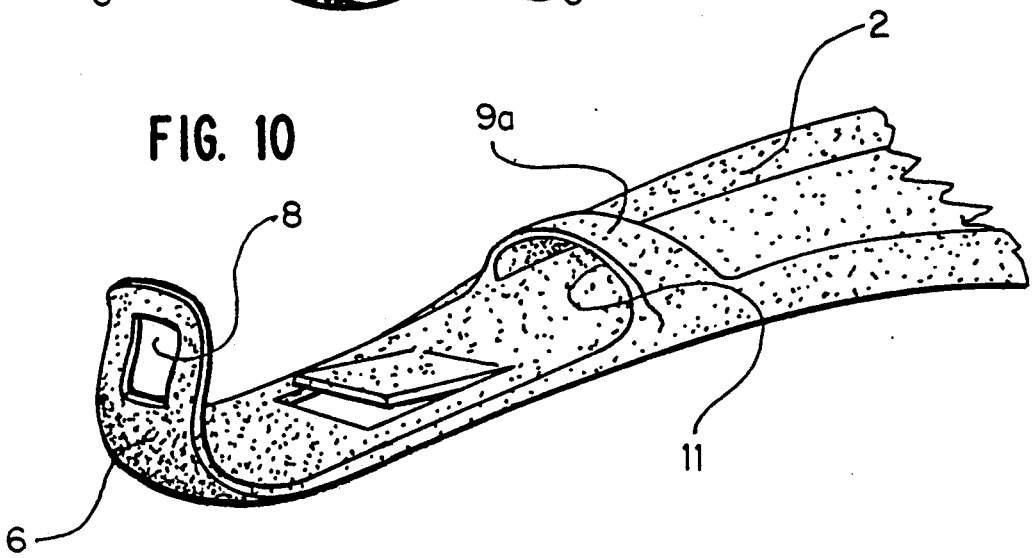
Figure 11:
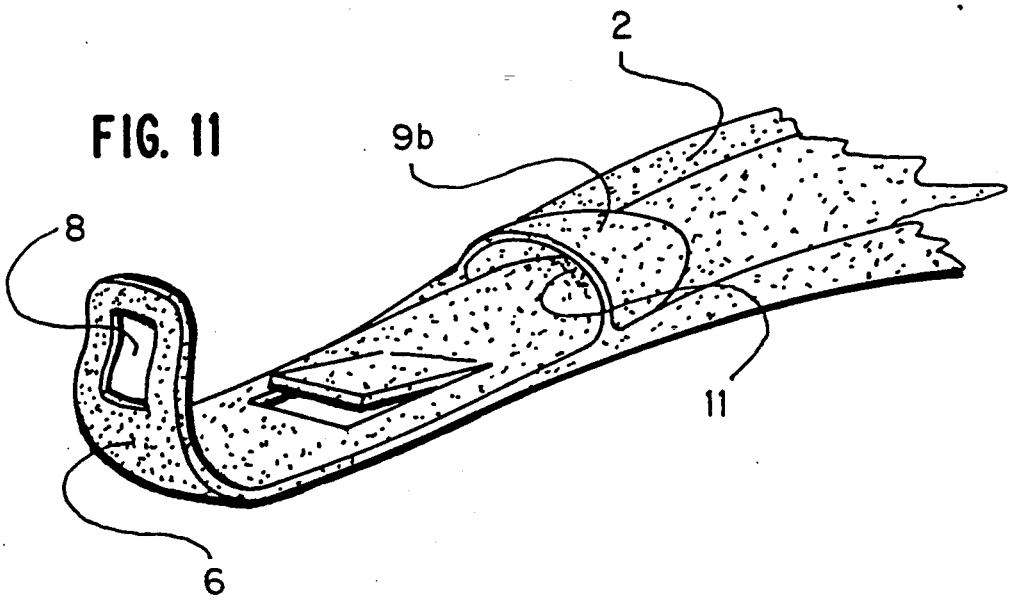

FIGS. 10 and 11 show different configurations of the toe holder associated to the blade for the restraint of the front portion of the shoe 3: in the first case it is simply provided a transverse bridge-shaped band 9*a*, which can be formed in one piece by moulding with the blade 2, while in the second case a pocket 9*b*, possibly flexible and/or soft, is provided. In both cases the need of the rigid tip element 23 of the sole 16 is suppressed.

Figure 13:
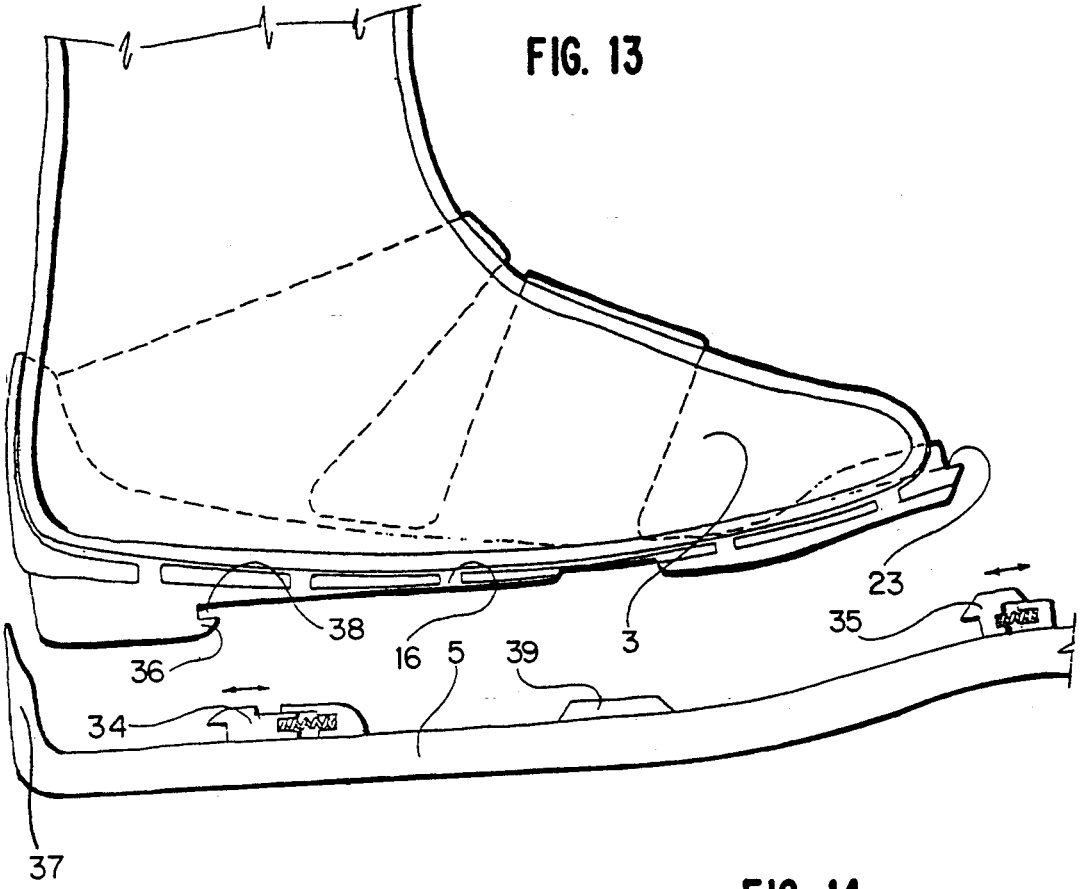

FIG. 13 shows an embodiment wherein the coupling between the shoe 3 and the blade 2 can be obtained by a simple translation movement from above downwardly of the user's foot. In this case, the heel locking member 6 is limited to a simple rear wall 37, and the sole 16 is provided with a heel 36 having an undercut recess 38 intended to be engaged by a spring latch 34 slidable on the plate 5 in the longitudinal direction thereof. The toe holder is also constituted by a spring latch 35, adapted to engage the tip portion 23 of the sole 16. Moreover, a positioning wedge 39, preferably conical, is formed on the plate 5 for guiding the sole 16 into the correct locking position, preventing translations of the shoe 3 on the horizontal plane.

The latches 34 and 35 could also be constituted by mechanically equivalent systems, possibly even provided with elastic or of different type safety members, intended to be only voluntarily disengaged by the user.

Figure 14:
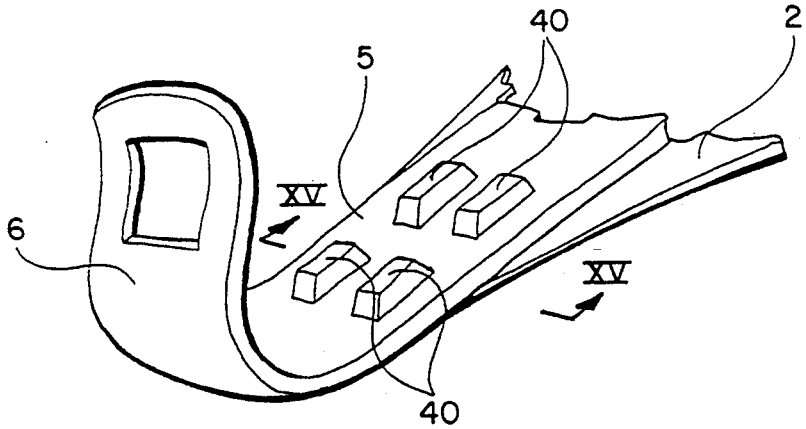
Figure 15:
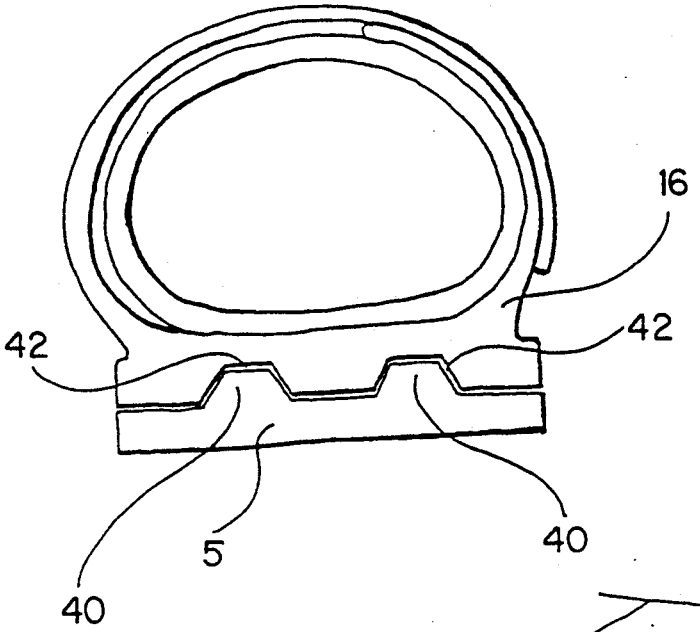
Figure 16:
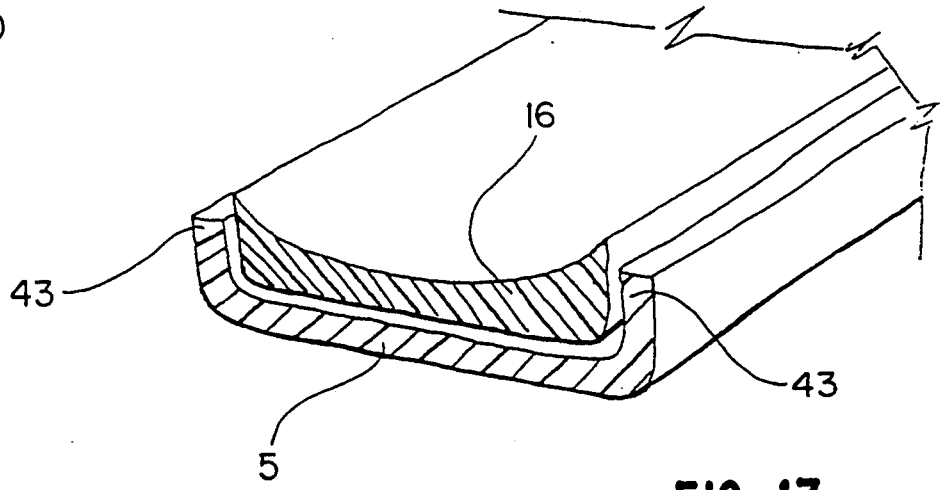

FIGS. 14, 15 and 16 show provision of positioning members formed by prismatic or frusto-pyramidal projections 40, or by male and female ribs 41, 42, or simply by lateral walls 43 for a form coupling between the sole 16 and the blade 2, in such a way that, during coupling operation, the shoe 3 can be guided towards the correct engagement position and, after engagement by the heel locking member 6, locked in position so as to prevent translations thereof along directions parallel to the blade plane.

Figure 17:
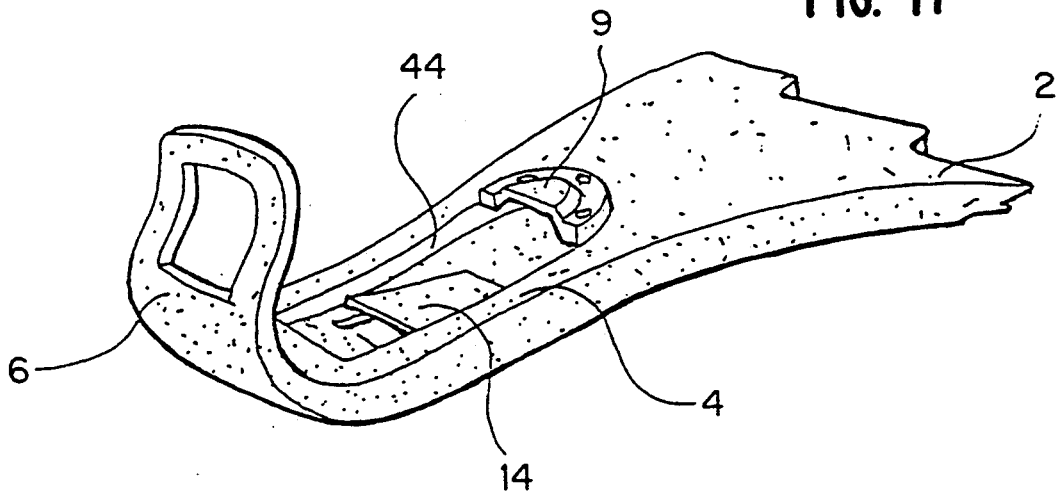

The same effect can be obtained according to the solution shown in FIG. 17, wherein the whole rear portion 4 of the blade 2 is formed with a recess 44 (with two, three or four walls) adapted to receive and house therein the sole 16.

The sole 16 can be provided inferiorly with suitable areas covered by rubber, even knurled or anyway anti-slipping, so as to render ambulation more safe.

Figure 19:
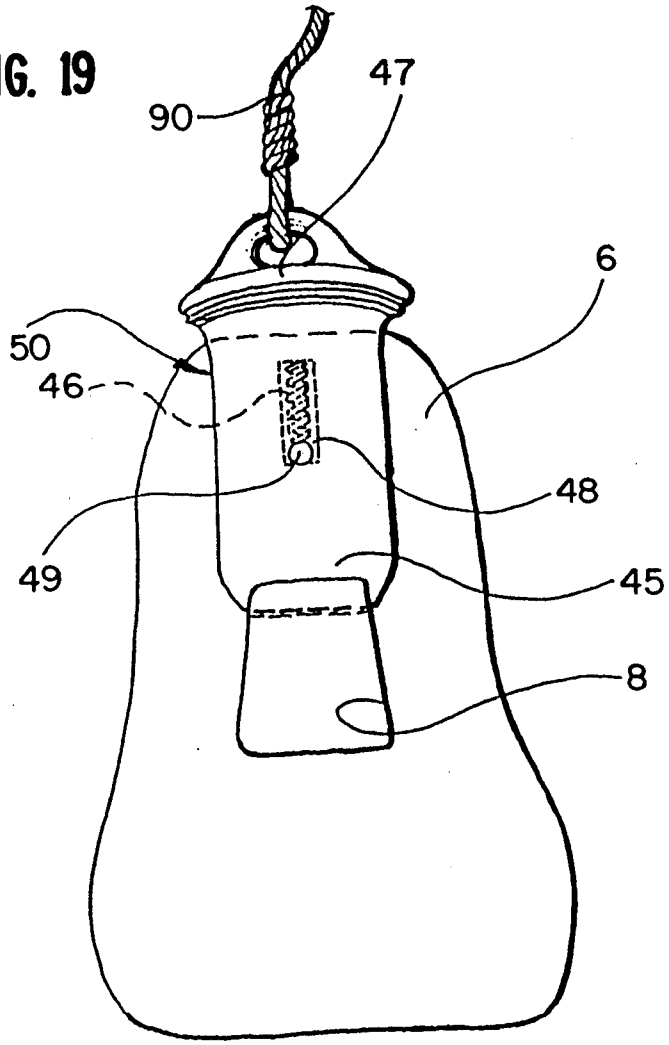
FIG. 19 is a back elevation view according to arrow XIX of FIG. 18.
Figure 18:
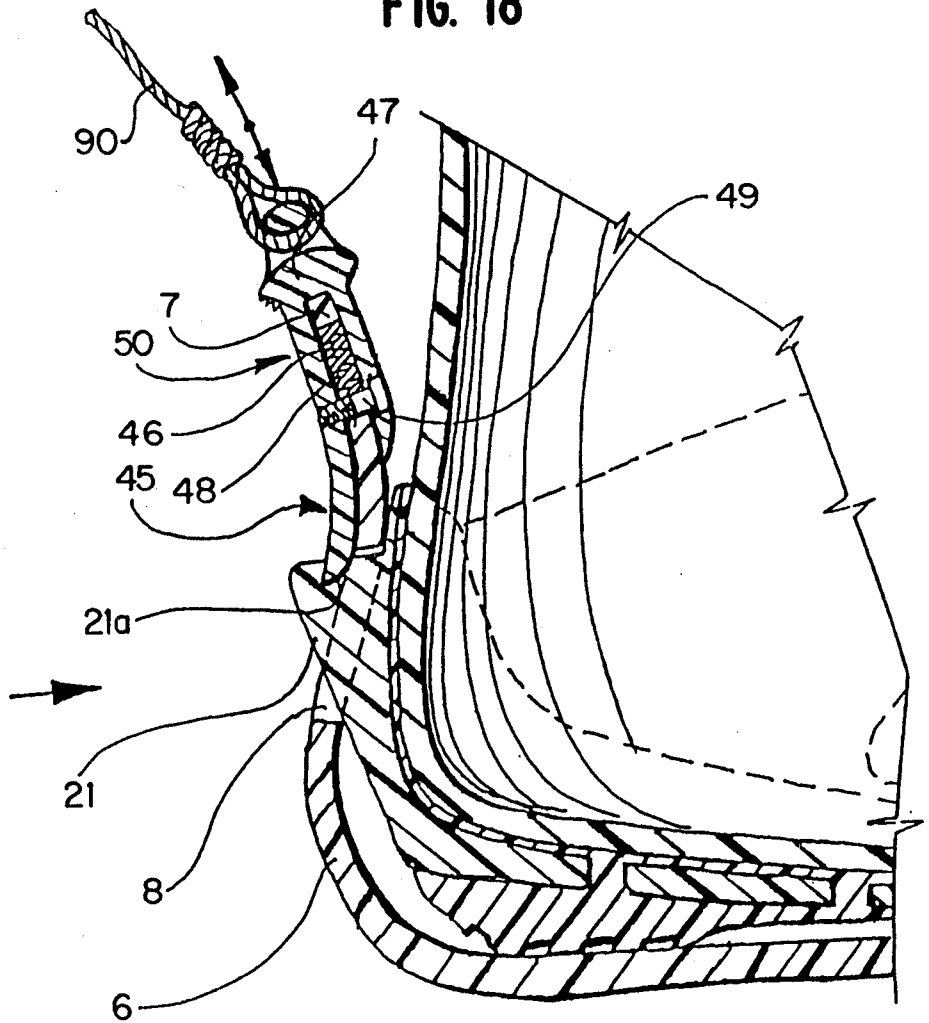
FIG. 18 is a partially sectioned view of a further embodiment of the invention.

A further safety system for preventing accidental or undesired disengagement of the shoe 3 relative to the blade 2 is shown in FIGS. 18 and 19. This system comprises a substantially fork-shaped body 50, slidably mounted on the upper end 7 of the heel locking member 6 and whose rear branch, having a longer dimension, defines a latch 45 adapted to engage from above the seat or notch 21*a* formed in the upper portion of the hooking tooth 21. The body 50, and thus the latch 45, are normally urged downwardly into the operative position shown in the drawings, under the action of a thrust spring 46 housed within an aperture 48 formed in the heel locking member 6 above the opening 8. This spring 46 reacts superiorly against the upper edge of the aperture 48 and inferiorly against a transverse element 49, for instance a screw, carried by the body 50 and extending through the aperture 48. The screw 49 also performs the task of securing the body 50 relative to the heel locking member 6.

In order to displace the latch 45 into a raised position for unlocking the tooth 21, the body 50 is provided superiorly with a grip portion 47 acting as a manoeuvre handle.

In use, only the voluntary but instinctive action of catching the body 50 by means of the handle 47, so as to raise the latch 45 and thus deforming rearwardly the heel locking member 6, will allow disengagement of the tooth 21.

To the aim of further facilitating catch of the handle 47, the latter can be provided with suitable projections or even with a string or web so as to make the operation still more convenient. In this case one end of the string, partially indicated as 90, is to be connected to the body 50, and the other end can either be free, or positioned with hook-end-loop fastener inserts or equivalent systems on the neoprene of the boot, and even secured to the user's diving suit. Moreover, the string 90 can be made by a fluorescent material, adapted to be easily located even under water.

According to a further alternative embodiment, not shown, the latch 45 could be made so that disengagement thereof can be actuated, instead of pulling same upwardly, by means of a thrust from above downwardly and thus following lowering thereof. This allows disengagement of the shoe from the blade without any need of a manual intervention, but simply intervening with the user's heels, which is particularly convenient in the case of a completely dressed, and thus hampered diver.

FIGS. 20 through 22 show a preferred embodiment of the shoe 3 and sole 16 thereof. Even in this case the shoe 3 is formed by a foamed cellular neoprene boot 15, both inwardly and outwardly covered by an anti-tearing fabric and having a lateral slide fastener 51 for facilitating wearing thereof and one or more reinforcing patches 52.

The sole 16, which is also in this case permanently connected to the boot 15, is formed by a rigid but relatively flexible material, for instance thermoplastic polyurethane similar to the material adopted for ski-boot bodies, or flexible polyamide, or hard rubber. The shoe 16 is formed in the front area with the tip projection 23 protruding forwardly, and in the heel area with a wall 53 shaped same as the heel portion of the boot 15 and from which the hooking tooth 21 projects rearwardly. Actually the latter is detachably secured by means of a restrained joint to a support member 54 protruding in one piece from the back of the wall 53. This construction enables manufacturing of the hooking tooth 21 (shown in better detail in FIG. 22) by the most suitable material (rigid, anti-wear, anti-abrasion and anti-shock) for instance an acetalic resin or similar thermopolymers. Moreover, this conformation allows quick and easy replacement of the hooking tooth 21, if necessary.

The upper face of the sole 16, indicated as 55, is flat and is rigidly fixed, normally by glueing, to a corresponding lower flat wall 56 of the boot 15.

The lower face of the sole 16, shown in detail in FIG. 21, is provided with anti-skid material plates or projections 57, for instance of curable or thermoplastic rubber, soft polyurethane or the like, as well as with recesses or ribs 58 for the positioning thereof relative to the blade 2.

The sole 16 has two lateral walls 59 with respective projections 60 for the connection, by means of rivets 61, of two adjustable straps 62. The two lateral walls 59 stiffen the sole 16 in connection with bending rigidity, and are formed in the front portion thereof with respective V-shaped slits 63 adapted to allow bending upwardly of the tip portion of the shoe 3 so as to make ambulation still more comfortable.

A protection covering 64 is further provided for covering the tip portion of the shoe 3, which can be formed in one piece with the sole 16 or can be formed by a separate piece, for instance made by a more soft polyurethane material, welded to the front portion of the sole 16 after assembling thereof with the boot 15.

Rigid connection between the boot 15 and the sole 16 can be obtained, besides glueing, with other technologies, such as for instance by compression under press, adhesion by overmoulding, or by means of injection of a binding material between the two parts.

The hooking tooth 21 is formed according to this embodiment with a slidable coupling member 65 for its connection to the support 54, to which the tooth 21 is then fixed by means of screw 66*a*. Like in the other previously disclosed embodiments, the hooking tooth 21 has a back arcuated skid surface 22. Additionally, it is provided superiorly with a flexible safety tab 66, whose function is to prevent (as it will be clarified in the following) accidental or undesired disengagement from the heel locking member 6 in the coupled condition between the shoe 3 and the blade 2. Naturally the hooking tooth 21 can be designed with different shapes, both in the case same is made in one piece with the sole 16 and the case it is constituted by a distinct element which can be separated from the sole 16. Same applies to the safety system against undesired disengagement: the only fundamental required features thereof consist of a rear vertical-oblique skidding surface, so as to facilitate the engagement operation between the shoe 3 and the blade 2, and a generally horizontal upper surface for restraint during swimming.

Figure 24:
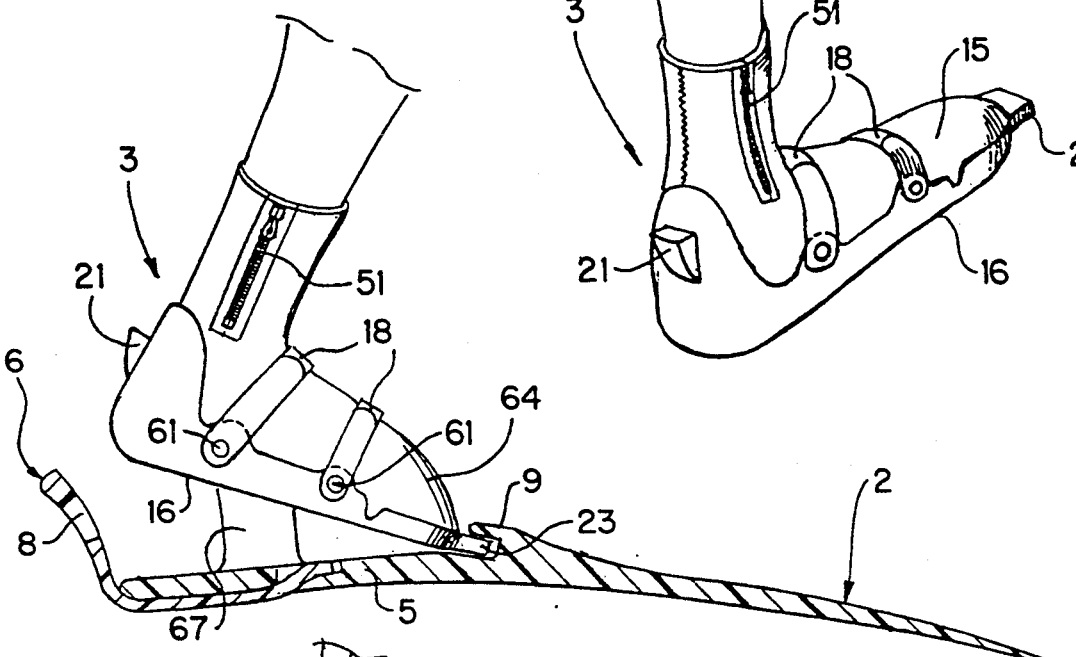
Figure 23:
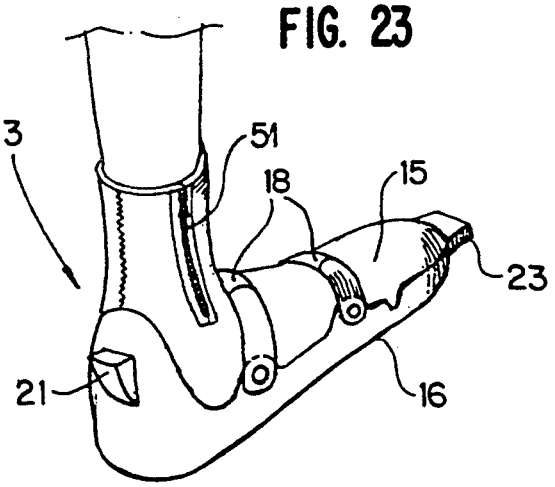
Figure 25:
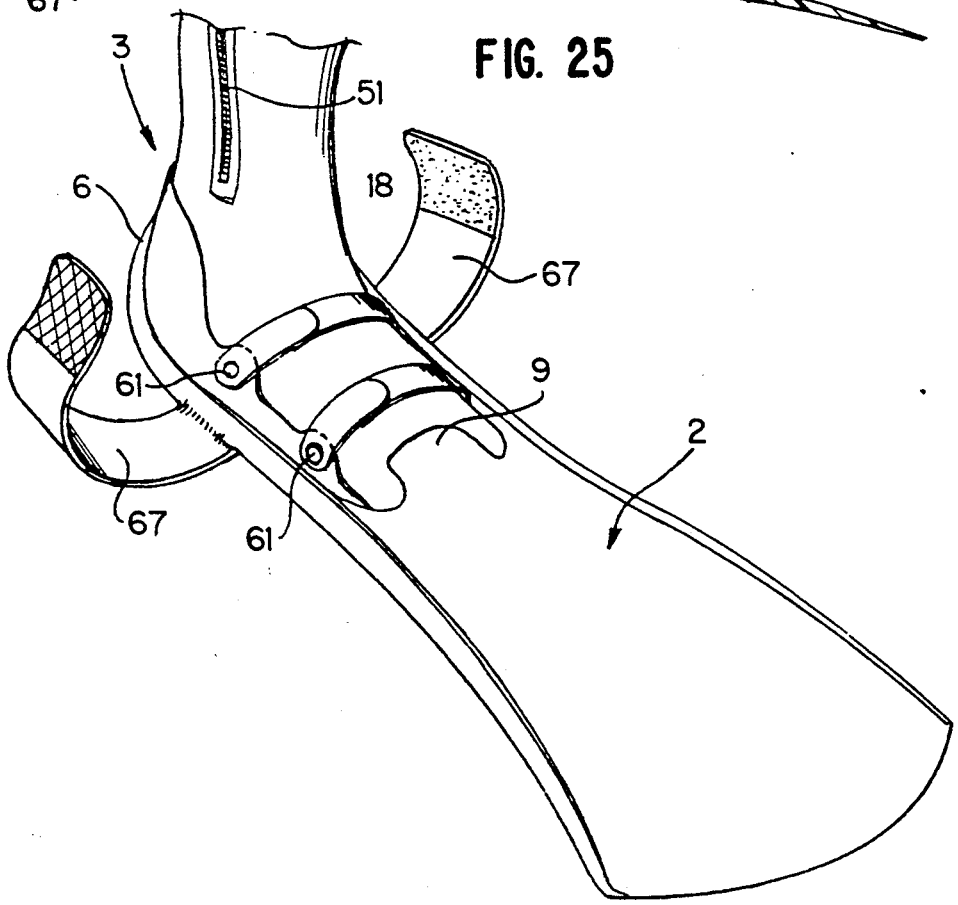

FIGS. 23 through 25 diagrammatically show the "step-in" coupling phases between the shoe 3 and the blade 2 generally according to the embodiments disclosed in the above, wherein coupling is accomplished by a composite translation-rotation motion of the shoe 3, firstly bringing the tip portion of the shoe 3 into contact on the blade 2 and then rotating the heel portion thereof downwardly.

The initial operation (FIG. 23) consists of wearing the shoe 3 on the user's foot and locking, and if necessary tightening, the two straps 18. In this condition ambulation is possible.

Then (FIG. 24) the tip projection 23 of the shoe 3 is inserted within the toe holder 9, following an oblique translation maintaining the heel portion of the shoe 3 in a raised position.

Thereafter, by rotating the heel portion of the shoe 3 downwardly, snap-fit engagement between the hooking tooth 21 and the opening 8 of the heel locking member 6 is obtained (FIG. 25), corresponding to the swimming position.

In the coupled condition, the user can desire a more rigid, more safe and more firm connection with the blade 2. To this effect, and also to the aim of safety for absolutely excluding any possibility of accidental disengagement of the shoe 3 relative to the blade 2, as well as for ensuring a still better power transmission by the foot to the flipper 1, an optional additional holding system is contemplated, constituted for instance by an auxiliary open strap shown as 67 in FIG. 25, whose ends are provided with buckle or hook-and-loop fasteners. The strap 67 is permanently secured to the area of the blade 2 beneath the user's foot, and is intended to be closed onto the foot after the coupling operation between the shoe 3 and the blade 2.

The safety strap 67 can also perform the auxiliary task of further preventing bending of the tip portion of the sole 16 during swimming, thus avoiding any risks of accidental disengagement of the tip projection 23 from the toe holder 9.

Figure 27:
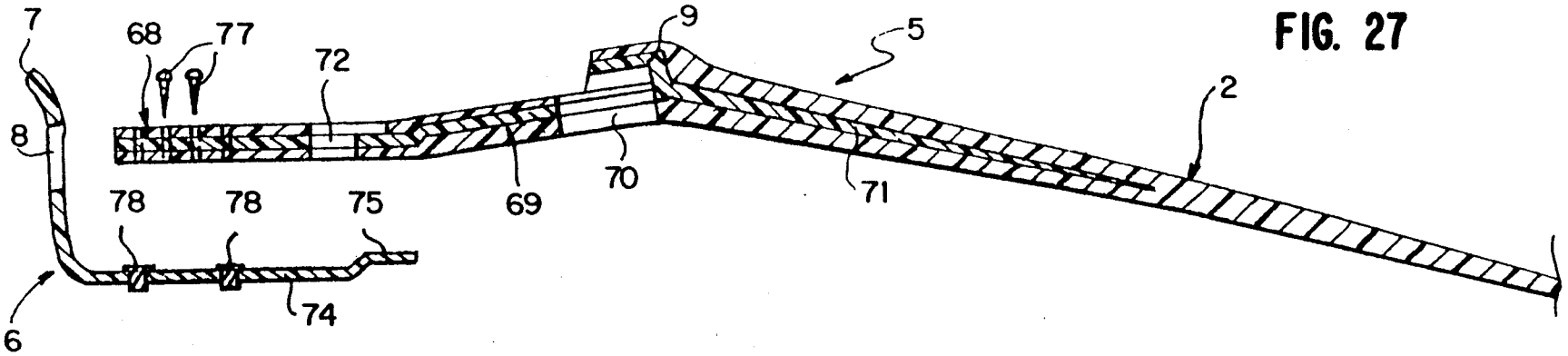
FIG. 27 is a longitudinally sectioned view of FIG. 26, with the components thereof shown prior to assembly.
Figure 28:
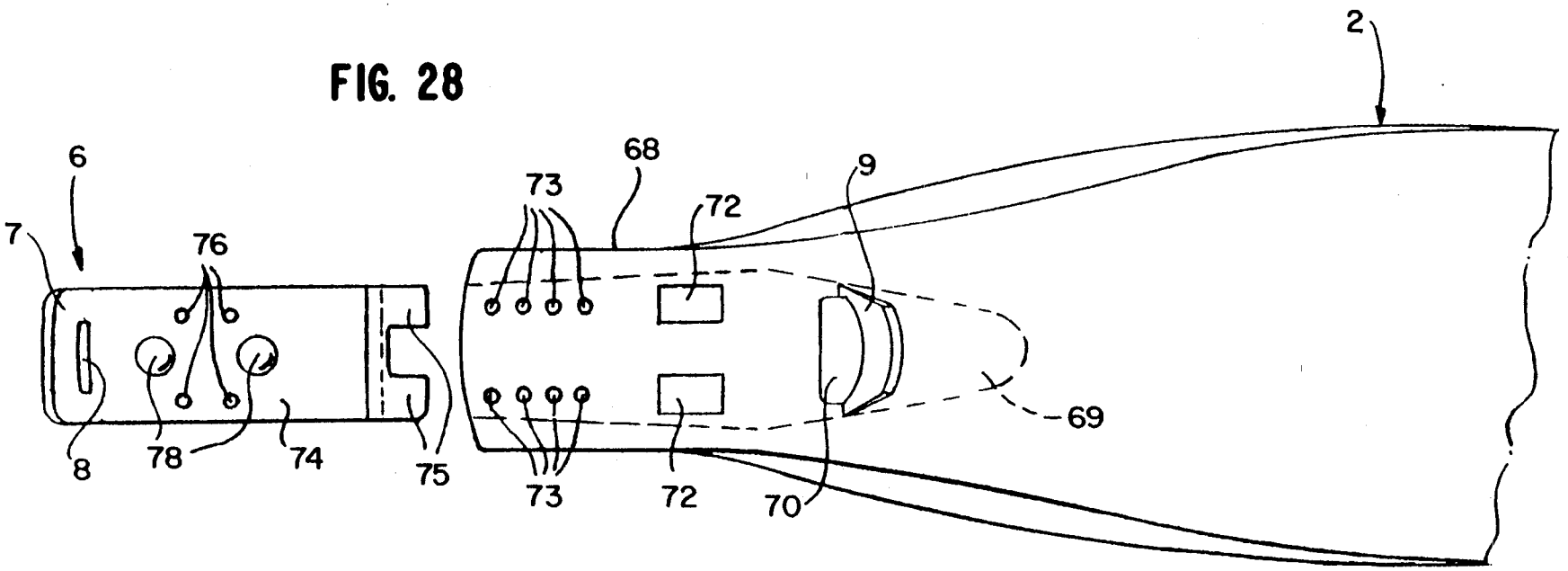
FIG. 28 is a top plan view of FIG. 27.

FIGS. 26 through 28 show a preferred embodiment of the blade 2 and of the heel locking member 6, which is particularly adapted for use with the shoe 3 according to FIGS. 20 through 22. In this embodiment, which is in principle similar to that disclosed with reference to FIG. 5, only the heel locking member 6 proper is formed by an element distinct from the blade 2 and applied to a rear tapered end 68 thereof. The blade 2 is constituted by a hydrodynamic thrust body, designed with the usual blade shapes of conventional flippers, and incorporates within the rear end 68 thereof and insert 69, which is formed by separate moulding with a rigid, less flexible, more resistant and anti-shock plastic material (polypropylene, polycarbonate, nylon, acetalic resin), and subsequently incorporated within the blade 2 by co-moulding. In other words, the insert 69 is placed in the mould of the blade 2 and embedded within the mass material thereof, normally E.V.A., polyurethane, PVC or any other material adapted for flipper blades. The insert 69, which is substantially flat in the area corresponding to the foot sole of the user, defines the toe holder 9 intended to receive therein the tip projection 23 of the shoe 3. Such insert 69 is further provided with a through opening 70 placed beneath the toe holder 9 for allowing rotation of the tip projection 23 during coupling/uncoupling of the shoe 3 relative to the blade 2, and moreover is preferably formed with a front appendage 71, protrudring in front of the toe holder 9 and whose function is to more efficiently transmit the swimming power to the blade 2.

The insert 69 is further formed with one or, as in the case of the shown example, two openings 72, placed near to the toe holder 9 and intended for connection of the heel locking member 6. Near to the openings 72, the insert 69 is formed with two sets of through holes 73 also for use in the connection of the heel locking member 6.

The heel locking member 6 is made by a flexible material, since whenever the shoe 3 is engaged and disengaged relative thereto, it must elastically bend so as to allow rearward rotation of the wing 7 with the opening 8 for the hooking tooth 21 of the shoe 3. In front of the wing 7, it has a substantially flat portion 74, which is placed below the terminal portion of the rear end 68 of the blade 2, and terminates at the end opposite to the wing 7 with a raised double nose 75 engaging the insert 69, through the openings 72 thereof.

The central flat portion 74 has pairs of holes 76 therethrough, corresponding to the holes 73 and by which the heel locking member 6 can be adjustably secured to the blade 2, by means of screws 77. In order to facilitate coupling and centering between the selected holes 73 and 76, the heel locking member 6 and the rear end 68 of the blade 2 can be provided with respective male and female centering elements (not shown).

With the above construction, the same blade 2 and the same heel locking member 6 can be used with shoes 3 of different sizes, simply varying the position between the holes 73 and the holes 76 relative to one another. This allows a considerable saving both of investments for moulds, and for storehouse stocks, with advantages also for the user. For example, a diving club shall have a reduced flipper stock-yard and simply adjust the position of the heel locking members of each pair of flippers upon rental to the user members.

A further advantage of this construction resides in that, forming the blade 2 and the heel locking member 6 as separate elements, it is possible to employ for each of them the most suitable material: in particular, a softer and less expensive material for the blade 2 (having larger dimensions), and a more expensive and high-performance material for the heel locking member 6 (having smaller dimensions).

In order to enable walking of the user wearing the flipper 1 on the deck of a boat or on the edge of a swimming pool without slipping, the heel locking member 6 can be provided inferiorly with anti-skid rubber projections, for instance constituted one by two or more transverse rubber members 78 crossing the central portion 74 and the heads of which are locked between the heel locking member 6 and the rear end 68 of the blade 2, after tightening of the screws 77. Alternatively, the rubber members 78 can be fixed by glueing or welding beneath the heel locking member 6 or even onto other selected areas of the blade 2.

As far as the front portion of the blade 2 in concerned, i.e. the active part in connection with swimming propulsion, same can be designed according to the widest range of shapes and structures, and for instance also employ the stratified E.V.A.-rubber structure according to European patent application EP-A-0436927, already mentioned in the above.

Figure 30:
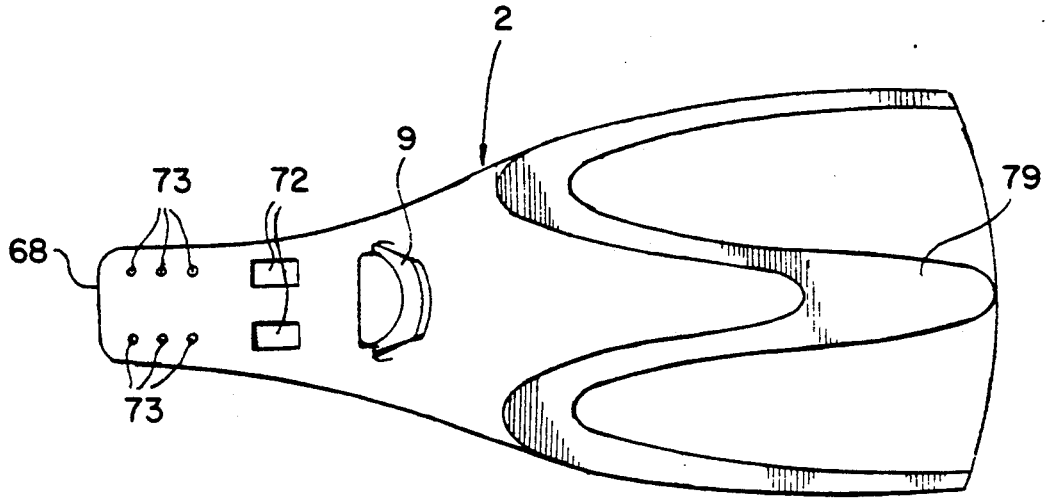
FIG. 30 is a top plan view of FIG. 29.

According to the embodiment shown in FIGS. 29 and 30, the insert 69 of FIGS. 26 through 28 is suppressed, and is in practice replaced by the rear end 68 itself of the blade 2 which extends forwardly for the entire length and width of the flipper, so as to constitute the blade 2 or at least the bearing structure thereof. With this construction evident advantages are obtained in terms of simplicity, lightness and economy, and it is further possible to overmould on selected areas of the blade 2 (for instance the central zone and the longitudinal edges thereof) a rubber covering 79, thus obtaining a multilayer structure according to the teaching of the above mentioned European application EP-A-0436927.

Figure 31:
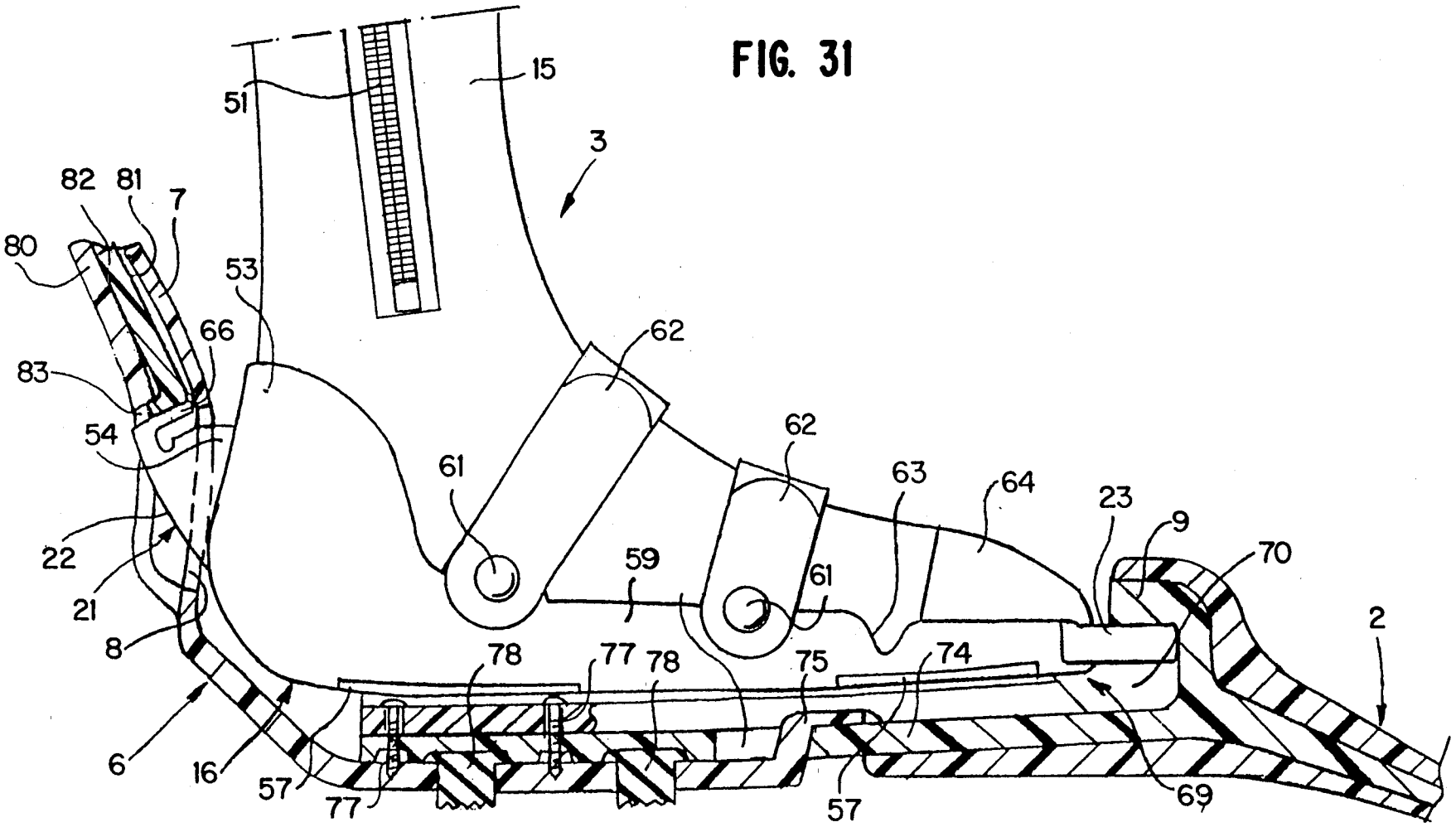
FIG. 31 is a view similar to FIG. 4 showing a further and preferred embodiment of the flipper according to the invention.

FIG. 31 shows the coupled configuration between the shoe 3 according to the preferred embodiment of FIGS. 20 through 22 and the blade 2 and heel locking member 6 according to the preferred embodiment of FIGS. 26 through 28, with the only difference that the wing 7 of the heel locking member 6 is formed superiorly with a double wall, i.e. with an outer wall 80 enclosing posteriorly the opening 8 and defining in the upper portion of the heel locking member 6 an interspace 81 in which a release member 82 is slidably mounted for unlocking of the hooking tooth 21. The release member 82 can be formed by a rod or stem adapted to be operated from above and whose withdrawal from the interspace 81 is prevented by a lower projection 83. The release member 82 cooperates with the safety elastic tab 66 of the hooking tooth 21, as follows. In the coupled condition between the shoe 3 and the heel locking member 6 shown in FIG. 31, the hooking tooth 21 is engaged through the opening 8 and the elastic tab 66 is placed behind and above the upper edge of the opening 8, so as to prevent disengagement therefrom of the hooking tooth 21. In order to allow disengagement, it is necessary to push manually the release member 82 downwardly, so as to elastically deform correspondingly the safety tab 66, i.e. shifting it below the upper edge of the opening 8. In this position the heel locking member 6 can be deflected rearwardly, so as to disengage the hooking tooth 21 and thus allow separation of the shoe 3 and blade 2 relative to each other.

Figure 32:
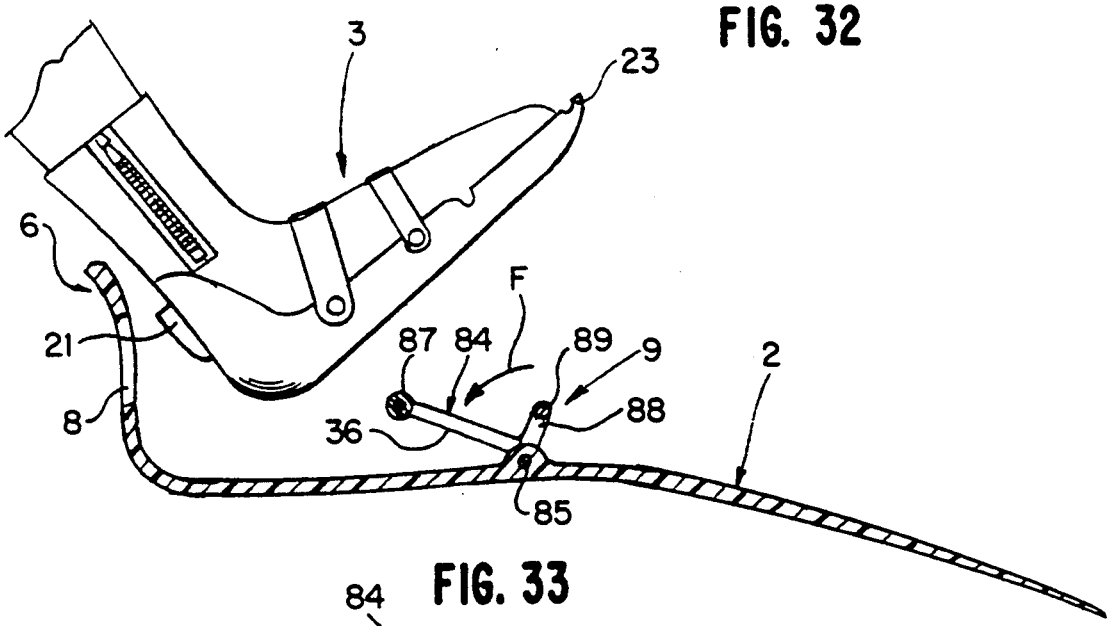
FIG. 32 is a view similar to FIG. 24 showing a further embodiment of the invention.
Figure 33:
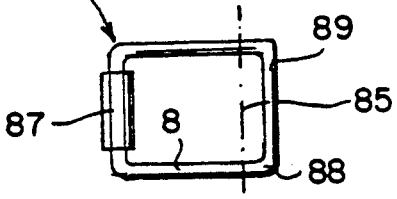
FIG. 33 is an enlarged top plan view of the element indicated by arrow XXXIII in FIG. 32.

Lastly, FIGS. 32 and 33 diagrammatically show a further embodiment wherein the coupling movement between the shoe 3 and the blade 2 is performed by means of an inverse translation-rotation motion, i.e. firstly approaching the heel portion of the shoe 3 into contact on the blade 2, so as to engage the hooking tooth 21 within the opening 8 of the heel locking member 6, and then rotating downwardly the tip portion of the shoe 3, thus locking the tip projection 23 relative to the toe holder 9.

In this case the toe holder 9 is formed, instead of a fixed element, by a pivoting device constituted by a bell-crank lever 84 articulated on the blade 2 around a transverse axis 85 and having a longer rear arm 86 carrying a roller 87, and a shorter front arm 88 carrying a locking bridge 89. An elastic device, not shown in the drawings, can be associated to the bell-crank lever 84, such as when the tip portion of the shoe 3 is lowered against the blade 2 thus pushing downwardly the roller 87, the locking bridge 89 rotates in the direction indicated by arrow F in FIG. 32, so as to snap-lock over the tip projection 23.

According to an alternative embodiment, engagement can be performed simply following rotation of the lever 84 and locking thereof in the rotated position, by means of well known systems not illustrated but within the knowledge of the man skilled in the art, adapted to be operated either automatically or manually.

With the construction of FIGS. 32 and 33 the heel locking member 6 is normally rigid, since it is neither necessary nor desirable that same deflects rearwardly.

Lastly, it is to be pointed out that for the manufacturing of the blade 2 any suitable material can be selected (for instance less valuable and thus less expensive, or more efficient under the point of view of elasticity and resistance), without any constraint of chemical character, contrary to the case of the flippers presently available on the market wherein, in order to allow permanent connection of the shoe by overmoulding, it is necessary to employ for the flipper blade particular and normally costly materials (E.V.A. and the like).

As a further advantage, the blade 2 of the flipper 1 according to the invention can be formed with any desired shape, independently of foot size, within a wide range of dimensions, structures and chemical characteristics. Moreover, by virtue of the essence itself of the invention, the blade can be easily changed with others, either identical spare blades or structurally and/or functionally and/or aesthetically different blades.

What I claim is:

1. Swimming flipper comprising a blade of flexible but relatively rigid material having a rear end and a shoe of relatively soft and elastically deformable material associated to said rear end of the blade, wherein the blade and the shoe are constituted by two distance elements which can be separated from each other and are provided with mutual restrained-joint disengageable coupling means including step-in means comprised of forward rigid means and rearward snap-lock means performing quick automatic engagement between said shoe and said blade following approach of the shoe and blade relative to each other in a direction substantially perpendicular to the plane of the blade.

2. Flipper according to claim 1, wherein said step-in means includes a substantially rigid sole associated with the shoe and having a forward end projection and a heel portion, and a toe holder and a heel locking member associated with the blade nd cooperating with said forward end projection and with said heel portion of said sole, respectively.

3. Flipper according to claim 2, wherein the heel portion of the shoe is provided with a hooking-tooth and the heel locking member of the blade comprises an elastically deformable wing projecting in a direction substantially perpendicular to the blade and having a recess therein adapted to be snap-engaged by said hooking tooth.

4. Flipper according to claim 3, wherein the hooking tooth and the heel locking member are provided with respective skid surfaces slidingly cooperating with each other during approaching of said shoe and blade relative to each other in a direction substantially perpendicular to the plane of the blade so as to enable snap-engagement of said hooking tooth within said recess of the heel locking member.

5. Flipper according to claim 3, further comprising safety means for preventing accidental disengagement of said shoe and blade relative to each other.

6. Flipper according to claim 5, wherein the safety means comprise an elastic thrust member acting so as to urge said hooking tooth into engagement within said recess of the heel locking member.

7. Flipper according to claim 5, wherein the safety means comprise a spring pawl articulated to said hooking tooth.

8. Flipper according to claim 5, wherein said recess of heel locking member has an upper edge and the hooking tooth of the shoe is provided with seat means adapted to be engaged by said heel locking member in correspondence of upper edge of the said recess.

9. Flipper according to claim 8, wherein the heel locking member is provided with spring latch means slidable between a lowered locking position within said seat means of the hooking tooth, and a raised unlocking position.

10. Flipper according to claim 9, wherein said spring latch means is provided with maneuver means.

11. Flipper according to claim 10, wherein the maneuver means comprises a maneuver string having one end attached to said spring latch means and an opposite end connected to apparel other than said blade.

12. Flipper according to claim 5, wherein said safety means comprise at least one flexible and adjustable strap attached to the blade and adapted to be tightened over the shoe.

13. Flipper according to claim 5, wherein said safety means comprise elastic tab means associated with said hooking tooth and acting so as to hold said hooking tooth into engagement within said recess of the heel locking member.

14. Flipper according to claim 13, wherein the heel locking member is provided with a slidable release means cooperating with said elastic tab means of hooking tooth for disengagement thereof relative to said recess of the heel locking member.

15. Flipper according to claim 2, wherein the toe holder is constituted by a bridge-shaped band integrally formed with the blade and adapted to embrace the forward end projection of the shoe.

16. Flipper according to claim 2, wherein the toe holder is formed by a pocket adapted to receive therein the forward end projection of the shoe.

17. Flipper according to claim 2, further comprising means for adjusting the distance between said toe holder and said heel locking member.

18. Flipper according to claim 2, further comprising plate means secured to said blade and carrying said toe holder and said heel locking member.

19. Flipper according to claim 18, wherein the elastic thrust member comprises a spring tab projecting from said plate means.

20. Flipper according to claim 2, wherein said toe holder and said heel locking member are directly secured onto the blade.

21. Flipper according to claim 2, wherein the sole has a unidirectional flexibility.

22. Flipper according to claim 2, wherein the sole is constituted by a planar member distinct from the shoe and to which an overshoe, releasably connected to the shoe, is associated.

23. Flipper according to claim 2, wherein the sole is integrated with the shoe.

24. Flipper according to claim 2, wherein the sole of the shoe and the area of the blade comprised between said holding toe and said heel locking member are provided with complementary positioning and locking means engageable with one another under a restrained joint.

25. Flipper according to claim 2, wherein the sole is constituted by a planar member distinct from the shoe and permanently fixed thereto.

26. Flipper according to claim 25, comprising adjustable strap means connecting said sole and said shoe to each other.

27. Flipper according to claim 2, wherein said toe holder is formed in one piece with the blade and said heel locking member is adjustably connected to the blade.

28. Flipper according to claim 2, wherein the heel portion of said shoe is provided with a hooking-tooth and the heel locking member of said blade is formed by a substantially rigid wing projecting in a direction substantially perpendicular to the blade and having a recess therein adapted to be engaged by said hooking tooth, and said toe holder comprises a swinging lever means for locking onto said forward end projection of the shoe.

29. Flipper according to claim 1, wherein said rearward snap-lock means is comprised of a heel locking member associated with said blade and having a hook-shaped terminal portion and said shoe has a heel portion with a hollow appendage adapted to be engaged by said hook-shaped terminal portion.

30. Flipper according to claim 1, wherein said quick automatic engagement is performed following a composite translation-rotation motion comprising a first translation phase to bring one of the tip and the heel of the shoe into contact on the blade, and a second rotation phase so as to bring also the other of the heel and the tip of the shoe into contact on the blade.

* * * * *